US011795730B2

(12) United States Patent
Hood

(10) Patent No.: US 11,795,730 B2
(45) Date of Patent: Oct. 24, 2023

(54) CYLINDRICAL LOCK STATUS INDICATOR

(71) Applicant: dormakaba USA Inc., Indianapolis, IN (US)

(72) Inventor: Brian H. Hood, Zionsville, IN (US)

(73) Assignee: dormakaba USA Inc, Indianapolis, IN (US)

( * ) Notice: Subject to any disclaimer, the term of this patent is extended or adjusted under 35 U.S.C. 154(b) by 336 days.

(21) Appl. No.: 17/174,664

(22) Filed: Feb. 12, 2021

(65) Prior Publication Data

US 2021/0310278 A1 Oct. 7, 2021

Related U.S. Application Data

(60) Provisional application No. 63/005,886, filed on Apr. 6, 2020.

(51) Int. Cl.
*E05B 41/00* (2006.01)
*E05B 47/00* (2006.01)

(52) U.S. Cl.
CPC ..... *E05B 41/00* (2013.01); *E05B 47/0038* (2013.01)

(58) Field of Classification Search
CPC .... Y10T 292/11; E05B 41/00; E05B 47/0038; E05B 15/0073; E05B 17/22; E05B 39/00
See application file for complete search history.

(56) References Cited

U.S. PATENT DOCUMENTS

| | | | |
|---|---|---|---|
| 4,936,896 A | 6/1990 | Takatsuka | |
| 5,548,984 A | 8/1996 | Miyatsu | |
| 6,441,735 B1 | 8/2002 | Marko et al. | |
| 6,883,357 B1 * | 4/2005 | Cheng | E05B 47/0038 70/91 |
| 10,563,425 B2 | 2/2020 | Lunday | |
| 2007/0214848 A1 | 9/2007 | Meyerle et al. | |
| 2015/0315816 A1 | 11/2015 | Gopalakrishnan et al. | |
| 2017/0342740 A1 * | 11/2017 | Basavaraju | E05B 41/00 |
| 2019/0234110 A1 | 8/2019 | Laporta | |
| 2019/0323264 A1 | 10/2019 | Lunday | |

FOREIGN PATENT DOCUMENTS

| | | | |
|---|---|---|---|
| CA | 3048575 | A1 | 10/2019 |
| CN | 1180780 | A | 5/1998 |
| CN | 105401796 | A | 3/2016 |
| CN | 107060518 | A | 8/2017 |
| CN | 208040078 | U | 11/2018 |
| DE | 202004009405 | U1 | 8/2004 |
| DE | 102019100639 | B3 | 3/2020 |
| EP | 3153192 | A1 | 4/2017 |
| JP | 04-049391 | A | 2/1992 |
| JP | 05-025960 | A | 2/1993 |

(Continued)

*Primary Examiner* — Christine M Mills
*Assistant Examiner* — Yahya Sidky
(74) *Attorney, Agent, or Firm* — Faegre Drinker Biddle & Reath LLP

(57) ABSTRACT

Lock indicators useable to signal the locked or unlocked state of a lock at both sides of a door selectively secured by the lock. For example, the present disclosure provides locks having an entry function or an intruder function with an indicator viewable by occupants of an area secured by the lock. In another example, the present disclosure provides a lock having a privacy function with an indicator viewable from external of an area secured by the lock.

16 Claims, 35 Drawing Sheets

(56) References Cited

FOREIGN PATENT DOCUMENTS

| | | | | | |
|---|---|---|---|---|---|
| JP | 07-054524 | A | | 2/1995 | |
| JP | 07-062937 | A | | 3/1995 | |
| JP | 08-013868 | A | | 1/1996 | |
| JP | 09-209625 | A | | 8/1997 | |
| JP | 2002-106220 | A | | 4/2002 | |
| JP | 2018-145731 | A | | 9/2018 | |
| RU | 2749442 | C1 | * | 6/2021 | ..... E05B 47/00 |
| WO | 01/77467 | A1 | | 10/2001 | |

* cited by examiner

CYLINDRICAL LOCK STATUS INDICATOR

RELATED APPLICATIONS

This application claims the benefit of U.S. Provisional Application No. 63/005,886 filed Apr. 6, 2020, titled CYLINDRICAL LOCK STATUS INDICATOR, the entire disclosure of which is expressly incorporated by reference herein.

FIELD

The present disclosure relates to an access device and, in particular, to an access device having a lock and a lock status indicator.

BACKGROUND/SUMMARY

The present disclosure relates to an access device operable to selectively block and permit access through a barrier. The access device is exemplified as one of an entry function door lock, a privacy function door lock and an intruder function door lock, while the barrier is exemplified as a door.

Door locks can take a number of different forms, including cylindrical locks and mortise locks. In certain instances, one side of the door lock is always actuatable to allow egress, while the other side may be only selectively actuatable to allow ingress. It may be advantageous to signal to occupants that a door lock maintains the locked condition, limiting ingress. It may also be advantageous to signal to those desiring ingress that a door is locked, limiting ingress. For example, a lock may employ an "entry" or "intruder" function in which a key is needed to actuate the lock from the locked state to the unlocked state to allow ingress. Such locks are used, e.g., to secure classrooms. In a lock down situation, it would be advantageous for the classroom occupants to know that the lock was properly actuated to a locked condition limiting ingress to the classroom. Other exemplary locks include those employing a "privacy" function in which a lock release (i.e., an input that actuates the lock from the locked state to the unlocked state to allow ingress) can be actuated by rotating a slotted input using, e.g., a flat head screwdriver or coin. Such locks can be used to secure, e.g., bathrooms. With a lock employing a privacy function, it can be advantageous to signal to a potential seeker of ingress that the facility is occupied.

The present disclosure, in one form thereof, provides an access device operable to selectively block and permit access through a barrier, comprising: an egress actuator operable to receive an egress operator input motion to actuate the egress actuator to allow egress through the barrier from an egress side of the barrier; an ingress actuator operable to receive an ingress operator input motion to actuate the ingress actuator to allow ingress through the barrier from an ingress side of the barrier; a lock actuatable between a locked position and an unlocked position, the locked position of the lock positioning the lock in a locked condition blocking the ingress operator input motion from actuating the ingress actuator to allow ingress through the barrier; an indicator having a lock signal signaling the locked position of the lock and an unlock signal signaling the unlocked position of the lock, the indicator selectively displaying only one of the lock signal and the unlock signal, the indicator having a lock signal display position in which the lock signal is displayed and an unlock signal display position in which the unlock signal is displayed; a first magnet secured for movement with the lock between the locked position and the unlocked position; and a second magnet pivotable by the first magnet between a second magnet lock position and a second magnet unlock position, the second magnet pivotable between the second magnet lock position and the second magnet unlock position about a pivot axis intersecting the barrier, in the second magnet lock position a first magnetic force between the first magnet and the second magnet retaining the indicator in the lock signal display position, in the second magnet unlock position a second magnetic force between the first magnet and the second magnet retaining the indicator in the unlock signal display position.

In an example thereof, the first magnet is secured for axial movement with the lock between the locked position and the unlocked position.

In an example thereof, the lock further comprises a rose, the indicator positioned intermediate the barrier and the rose, the rose including a window through which the lock signal and the unlock signal are selectively viewable.

In an example thereof, the access device further comprises a rocker carrying the second magnet and pivotable about the pivot axis.

In an example thereof, the rocker comprises a pin retained in a yoke, the yoke secured for rotation with the indicator, the yoke rotatable about the axis of rotation by the pivoting of the rocker.

In an example thereof, the indicator is rotatable between the lock signal display position and the unlock signal display position about an axis of rotation spaced from the pivot axis.

In an example thereof, the indicator is viewable from an egress side of the barrier, the egress actuator extending from the egress side of the barrier, the egress actuator rotatable by the egress operator input motion, the first magnet comprising a pair of first magnets secured for rotation with the egress actuator, in a default position of the egress actuator, the pair of first magnets both supplying one of the first magnetic force and the second magnetic force, rotation of the egress actuator by the egress operator input motion rotating one of the pair of first magnets out of position to supply the one of the first magnetic force and the second magnetic force while the other of the pair of first magnets remains positioned to supply the one of the first magnetic force and the second magnetic force.

The present disclosure in another form provides an access device operable to selectively block and permit access through a barrier, comprising: an egress actuator operable to receive an egress operator input motion to actuate the egress actuator to allow egress through the barrier from an egress side of the barrier; an ingress actuator operable to receive an ingress operator input motion to actuate the ingress actuator to allow ingress through the barrier from an ingress side of the barrier; a lock actuatable between a locked position and an unlocked position, the locked position of the lock positioning the lock in a locked condition blocking the ingress operator input motion from actuating the ingress actuator to allow ingress through the barrier; a rose having a window; an indicator having a lock signal signaling the locked position of the lock and an unlock signal signaling the unlocked position of the lock, the lock signal and the unlock signal positioned intermediate the barrier and the rose, the indicator selectively displaying only one of the lock signal and the unlock signal through the rose window, the indicator having a lock signal display position in which the lock signal is displayed through the rose window and an unlock signal display position in which the unlock signal is displayed through the rose window; a first magnet moved by movement of the lock between the locked position and the unlocked position; and a second magnet moveable by the first magnet between a second magnet lock position and a second magnet unlock position, in the second magnet lock position a first magnetic force between the first magnet and the second magnet retains the indicator in the lock signal display position, in the second magnet unlock position a second magnetic force between the first magnet and the second magnet retains the indicator in the unlock signal display position.

In an example thereof, the access device further comprises a rocker carrying the second magnet and pivotable about a pivot axis, the second magnet pivotable by the first magnet between the second magnet lock position and the second magnet unlock position, the rocker positioned intermediate the barrier and the rose.

In an example thereof, the indicator is rotatable between the lock signal display position and the unlock signal display position about an axis of rotation spaced from the pivot axis.

In an example thereof, the rocker comprises a pin and the indicator comprises a yoke, the pin retained in the yoke, the yoke rotatable about the axis of rotation by the pivoting of the rocker.

In examples of the exemplary embodiments, either or both of the egress actuator and the ingress actuator extends through the rose through which the indicator signal is displayed.

In a further alternative embodiment thereof, the present disclosure provides an access device operable to selectively block and permit access through a barrier, comprising: an actuator operable to receive an operator input motion to rotate the actuator to allow access through the barrier, the actuator extending from a first side of the barrier; a lock actuatable between a locked position and an unlocked position, the locked position of the lock positioning the lock in a locked condition blocking the operator input motion from rotating the actuator to allow access through the barrier; an indicator having a lock signal signaling the locked position of the lock and an unlock signal signaling the unlocked position of the lock, the indicator selectively displaying only one of the lock signal and the unlock signal the indicator having a lock signal display position in which the lock signal is displayed and an unlock signal display position in which the unlock signal is displayed; a first pair of magnets moved by movement of the lock between the locked position and the unlocked position; and a second pair of magnets pivotable by the first pair of magnets between a second magnet lock position and a second magnet unlock position, in the second magnet lock position the first pair of magnets and the second pair of magnets cooperating to position the indicator in the lock signal display position, in the second magnet unlock position the first pair of magnets and the second pair of magnets cooperating to position the indicator in the unlock signal display position, in one of the second magnet lock position and the second magnet unlock position, one of the first pair of magnets is repulsed by one of the second pair of magnets while the other of the first pair of magnets is attracted by the other of the second pair of magnets, rotation of the actuator by the operator input motion rotating the one of the first pair of magnets to a position attracted by the other of the second pair of magnets, whereby the second pair of magnets maintains the one of the second magnet lock position and the second magnet unlock position during the operator input motion to rotate the actuator to allow access through the barrier.

In an example thereof, the actuator comprises an egress actuator and the one of the second magnet lock position and the second magnet unlock position comprises the second magnet lock position.

In an example thereof, the one of the second magnet lock position and the second magnet unlock position comprises the second magnet unlock position.

In an example thereof, the access device further comprises a rose, the indicator positioned intermediate the barrier and the rose, the rose including a window through which the lock signal and the unlock signal are selectively viewable.

In an example thereof, the access device further comprises a rocker carrying the second pair of magnets and pivotable about a pivot axis between the second magnet lock position and the second magnet unlock position, the actuator rotatable about a rotation axis spaced from the pivot axis.

In an example thereof, the rocker comprises a pin and the indicator comprises a yoke, the pin retained in the yoke, the yoke rotatable about the rotation axis by the pivoting of the rocker.

The present disclosure provides lock indicators useable to signal the locked or unlocked state of a lock at both sides of a door selectively secured by the lock. While described herein with respect to a door, the locks of the present disclosure are suitable for use with any barrier selectively allowing egress and ingress. For example, the present disclosure provides locks having an entry function and an intruder function with an indicator viewable by occupants of an area secured by the lock. In another example, the present disclosure provides a lock having a privacy function with an indicator viewable from external of an area secured by the lock. Throughout this document, "inside" will be used to reference the side of a door and lock actuator available to occupants of an area secured by the lock, while "outside" will be used to reference the side of a door and lock actuator available to those seeking ingress to the secured area.

In an exemplary embodiment of the present disclosure, a lock is provided, the lock comprising: a latch bolt moveable between an engaged position operable to limit ingress and egress and a disengaged position not operable to limit ingress and egress; an egress actuator operable to receive a first operator input motion to actuate the egress actuator to move the latch bolt from the engaged position to the disengaged position; an ingress actuator operable to receive a second operator input motion to actuate the ingress actuator to move the latch bolt from the engaged position to the disengaged position; a lock input actuatable between a locked position and an unlocked position, the locked position of the lock input positioning the lock in a locked condition blocking the second operator input motion from actuating the ingress actuator to move the latch bolt from the engaged position to the disengaged position; and an indicator having a lock signal signaling the locked position of the lock input and an unlock signal signaling the unlocked position of the lock input, the indicator selectively displaying only one of the lock signal and the unlock signal, the indicator having a lock signal display position in which the lock signal is displayed and an unlock signal display position in which the unlock signal is displayed.

In an example thereof, the indicator comprises: a rocker positioned and arranged to actuate the indicator between the lock signal display position and the unlock signal display position, the rocker having a rocker lock position positioning the indicator in the lock signal display position and the rocker having a rocker unlock position positioning the indicator in the unlock signal display position, the rocker moveable between the rocker unlock position and the rocker lock position by an actuation of the lock input between the locked position and the unlocked position.

In a further example thereof, the lock input magnetically interacts of the rocker to effect movement of the rocker between the rocker unlock position and the rocker lock position.

BRIEF DESCRIPTION OF THE DRAWINGS

The above-mentioned and other features and advantages of this disclosure, and the manner of attaining them, will become more apparent and will be better understood by reference to the following description of exemplary embodiments taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION OF THE DRAWINGS

Figure 1:
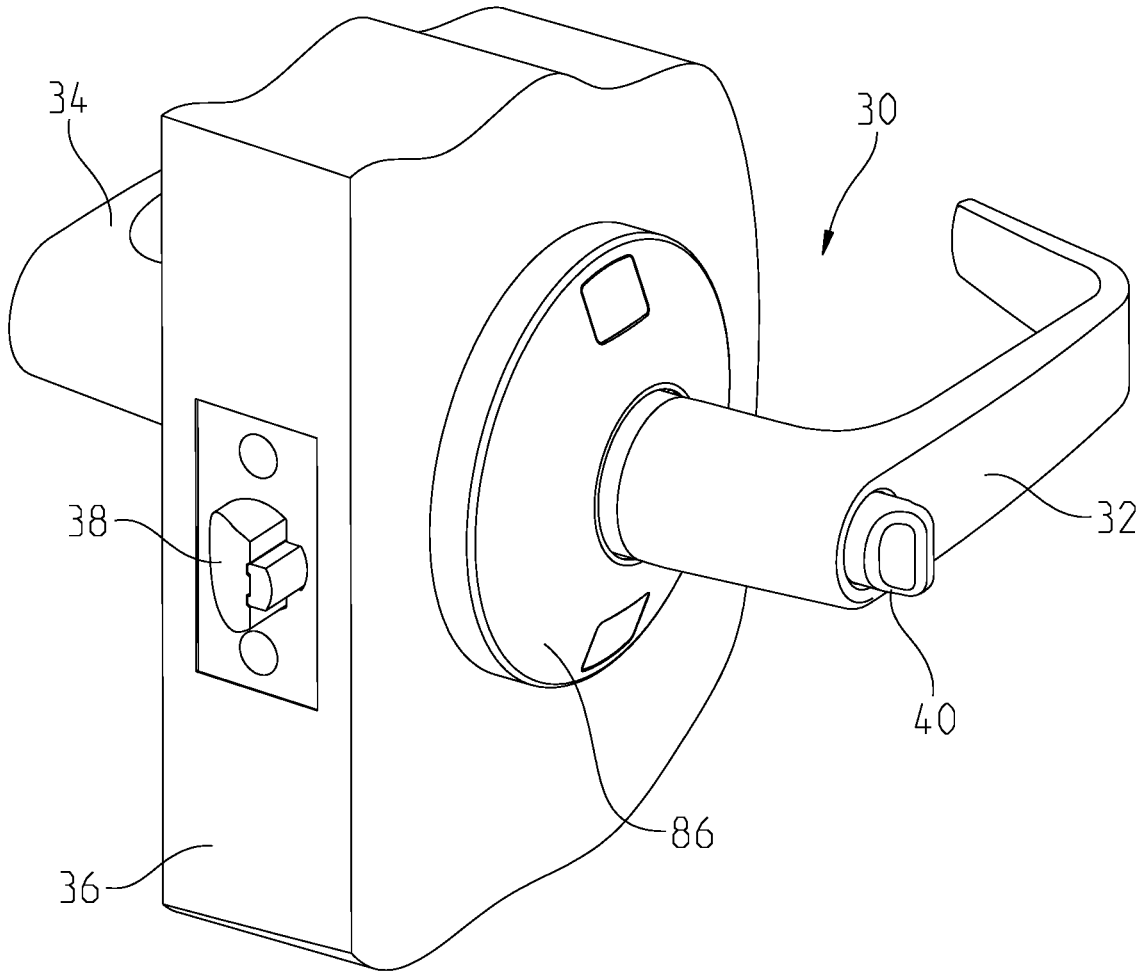
FIG. 1 is a perspective view of a cylindrical lock employing an entry function and an inside lock status indicator.

For the purposes of promoting an understanding of the principles of the present disclosure, reference is now made to the embodiments illustrated in the drawings, which are described below. The embodiments disclosed herein are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. Corresponding reference characters indicate corresponding parts throughout the several views.

The terms "couples", "coupled", "coupler" and variations thereof may be used to include both arrangements wherein the two or more components are in direct physical contact and arrangements wherein the two or more components are not in direct contact with each other (e.g., the components are "coupled" via at least a third component), but yet still cooperate or interact with each other.

In some instances throughout this disclosure and in the claims, numeric terminology, such as first, second, third, and fourth, may be used in reference to various components or features. Such use is not intended to denote an ordering of the components or features. Rather, numeric terminology is used to assist the reader in identifying the component or features being referenced and should not be narrowly interpreted as providing a specific order of components or features.

FIG. 1 illustrates entry function door lock 30. As illustrated, entry function door lock 30 is exemplified as a cylindrical lock. Cylindrical locks are well known in the art; therefore, in the description that follows only certain details of the exemplary locks are described in detail, with the detailed description instead focusing on the indicator apparatus and associated method of use.

As illustrated in FIG. 1, entry function door lock 30 includes an egress actuator exemplified as egress handle 32. Entry function door lock 30 further includes an ingress actuator exemplified as ingress handle 34. Entry function door lock 30 is operably coupled to door 36. Door 36 is, in use, arranged to selectively allow and disallow ingress and egress from an area selectively covered by door 36. In an exemplification, door 36 can be hinged to a doorframe and can be selectively secured thereto by latch bolt 38, as is well known in the art. In an unlocked state of entry function door lock 30, both egress handle 32 and ingress handle 34 can be actuated by an operator input motion to move latch bolt 38 from the extended position illustrated in FIG. 1 to a retracted position allowing ingress and egress through door 36. When one of egress handle 32 and ingress handle 34 is actuated to move latch bolt 38 to the retracted position, door 36 can be moved relative to its doorframe to allow ingress and egress therethrough.

Entry function door lock 30 includes an inside lock input exemplified as lock button 40. Lock button 40 is normally biased by compression spring 42 (FIG. 20) to the extended position illustrated, e.g., in FIGS. 1 and 17. This extended position of lock button 40 corresponds to an unlocked condition of entry function door lock 30. In this unlocked condition, ingress handle 34 can receive an operator input motion to rotate ingress handle 34 to actuate latch bolt 38 from its extended position to its retracted position. Mechanisms for translating rotation of ingress handle 34 (and egress handle 32) into reciprocation of latch bolt 38 are well known in the art and are not here explained for the sake of brevity. In its simplest form such a mechanism can take the form of a cam rotated by ingress handle 34 (if the lock is in its unlocked state) or egress handle 32 to reciprocate latch bolt 38 between its extended and retracted positions. Lock button 40 can be depressed by a user to the lock position illustrated in FIG. 18 to place entry function door lock 30 in a locked condition in which ingress handle 34 is blocked from rotation and; therefore, ingress through door 36 via ingress handle is prevented.

Figure 18:
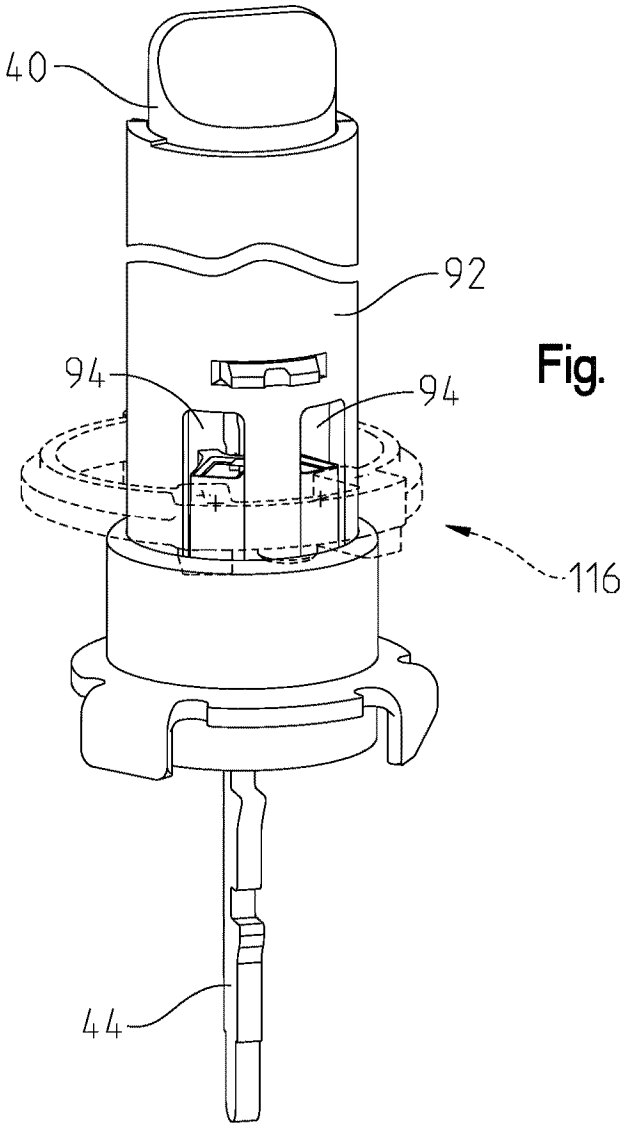
FIGS. 17 and 18 are perspective views illustrating operation of an indicator actuator assembly in accordance with the present disclosure.
Figure 17:
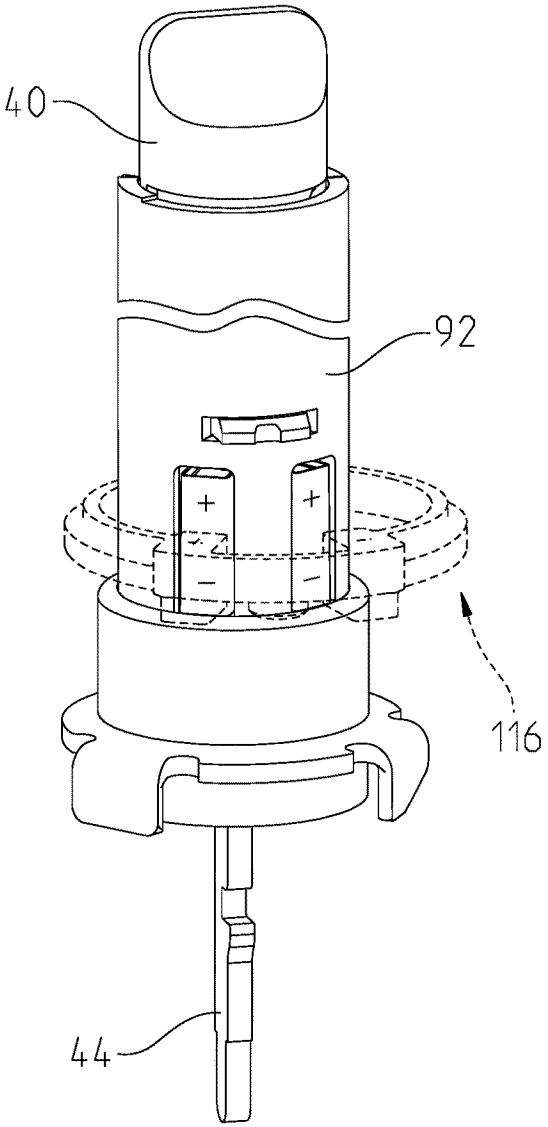
Figure 19:
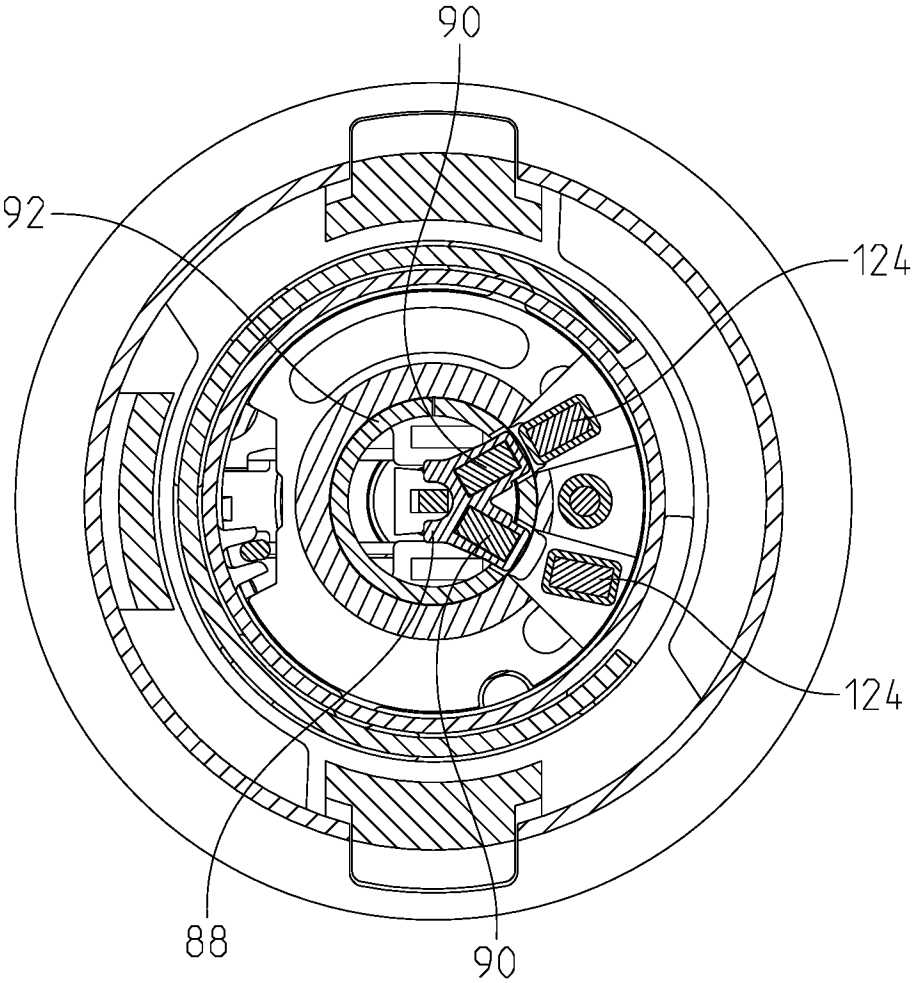
FIG. 19 is an axial sectional view illustrating the operation of an indicator actuation assembly of the present disclosure.

Lock button 40 can be actuated from the depressed, lock position illustrated in FIG. 18 to the extended unlock position illustrated, e.g., in FIGS. 1 and 17 in a variety of ways, including by actuation of egress handle 32 to retract latch bolt 38 and by rotation of an outside lock input. In the case of entry function door lock 30, the outside lock input generally takes the form of a keyed lock apparatus such as a small format interchangeable core (SFIC). The outside lock input can be keyed to a physical key or to an electronic key. In any event, a specialized input (i.e., a key) is needed to utilize the outside lock input to actuate lock button 40 and; therefore, actuate entry function door lock 30 from the locked to the unlocked condition. When the outside lock input is utilized to place the lock in an unlocked state, in many implementations, it simultaneously retracts the latch bolt. In the case of privacy function door lock 60, the outside lock input takes the form of unlock button 46. Unlock button 46 is not reciprocatable in use, but rather is rotatable to actuate lock button 40 to actuate privacy function door lock 60 from the locked to the unlocked condition. Unlock button 46 includes an outside accessible slot, into which a tool such as a flat head screw driver or a coin can be inserted to allow a user to rotate unlock button 46.

Except for the outside lock input (described above), the construction and operation of entry function door lock 30 and privacy function door lock 60 are nearly identical. Throughout this disclosure, shared elements of these two embodiments and their use environment are identified with the same reference numeral, even though they belong to different embodiments.

Figure 15:
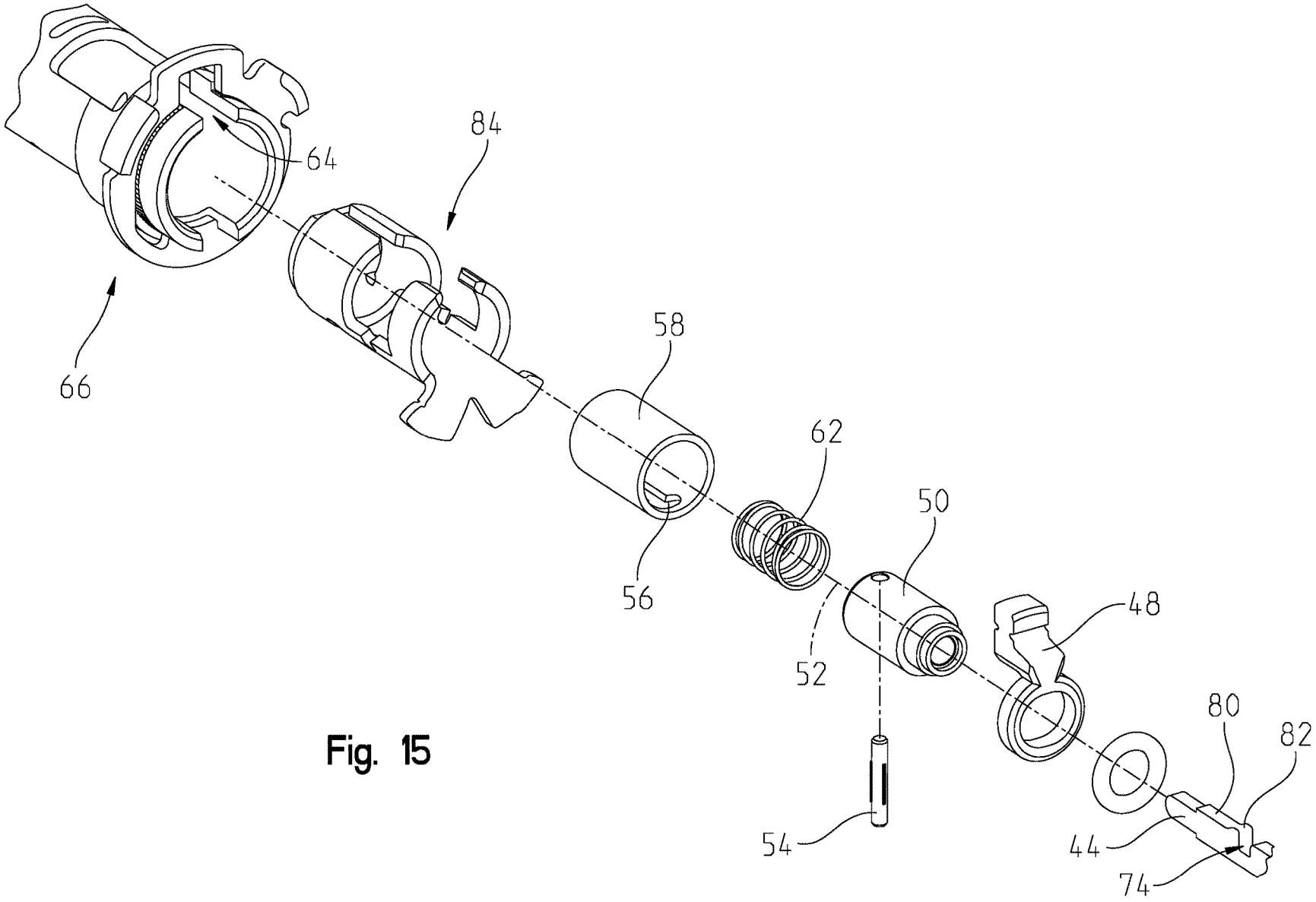
FIG. 15 is an exploded, perspective view of certain outside lock components.
Figure 20:
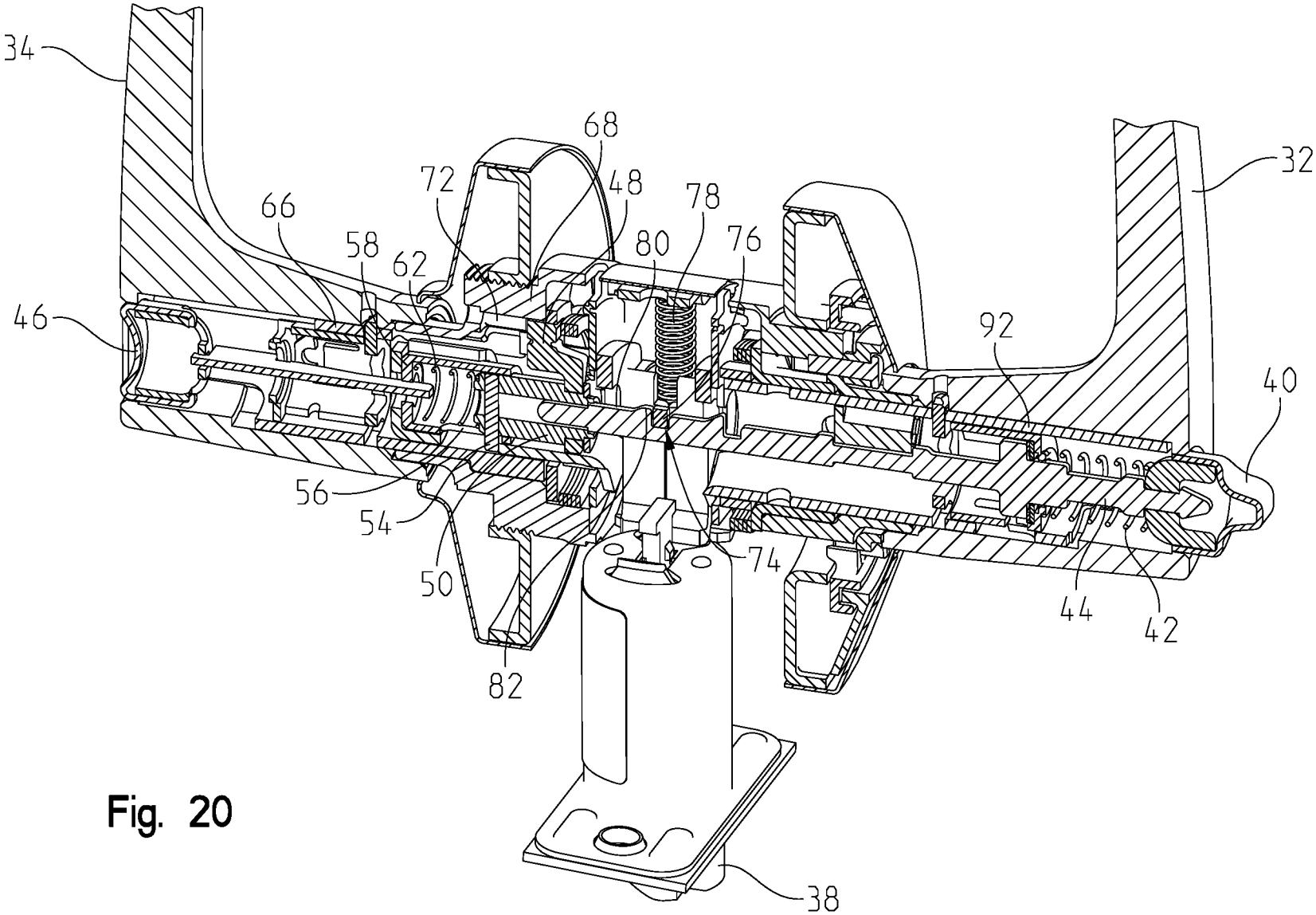
FIG. 20 is a perspective, sectional view of a privacy function door lock without the indicator assembly of the present disclosure.

Referring to FIG. 20, lock button 40 is secured to button bar 44 such that reciprocation of lock button 40 from its extended position (FIG. 17) to its retracted position (FIG. 18) similarly causes reciprocation of button bar 44 along its longitudinal axis 52 (FIG. 15). Button bar 44 is further secured for reciprocation along its longitudinal axis with locking lug 48. More particularly, locking lug 48 is secured to locking lug carrier 50 translationally relative to longitudinal axis 52 (FIG. 15) and locking lug carrier 50 is secured for translation along longitudinal axis 52 with button bar 44. When lock button 40 is depressed from its extended position (FIG. 17) to its retracted position (FIG. 18), locking lug 48 travels a similar distance along longitudinal axis 52.

Referring generally to FIGS. 7-9, 14-16 and 20, locking lug carrier 50 carries transverse pin 54 which rides in slot 56 of sleeve 58. Sleeve 58 includes an end wall against which compression spring 62 bears. Compression spring 62 also bears against locking lug carrier 50, biasing lock button 40 to its extended position (FIG. 17). When lock button 40 is depressed from its extended position to its retracted position (FIG. 18), compression spring 62 is compressed between the end wall of sleeve 58 and locking lug carrier 50. During this movement, locking lug 48 translates along longitudinal axis 52 within slot 64 of lever sleeve 66. Locking lug 48 is engaged with slot 64 throughout its range of motion along longitudinal axis 52.

Figure 2:
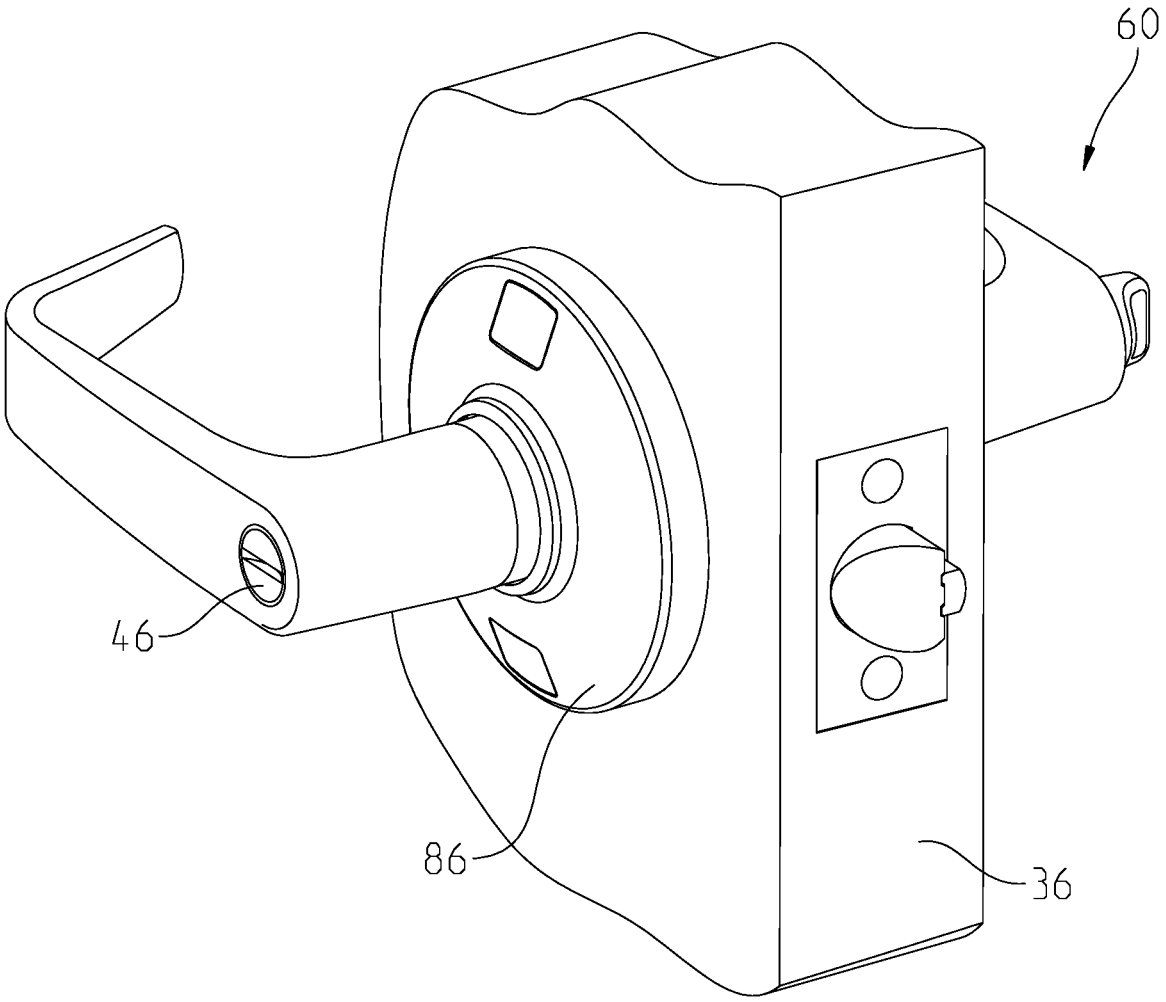
FIG. 2 is a perspective view of a cylindrical lock employing a privacy function and an outside lock status indicator.
Figure 3:
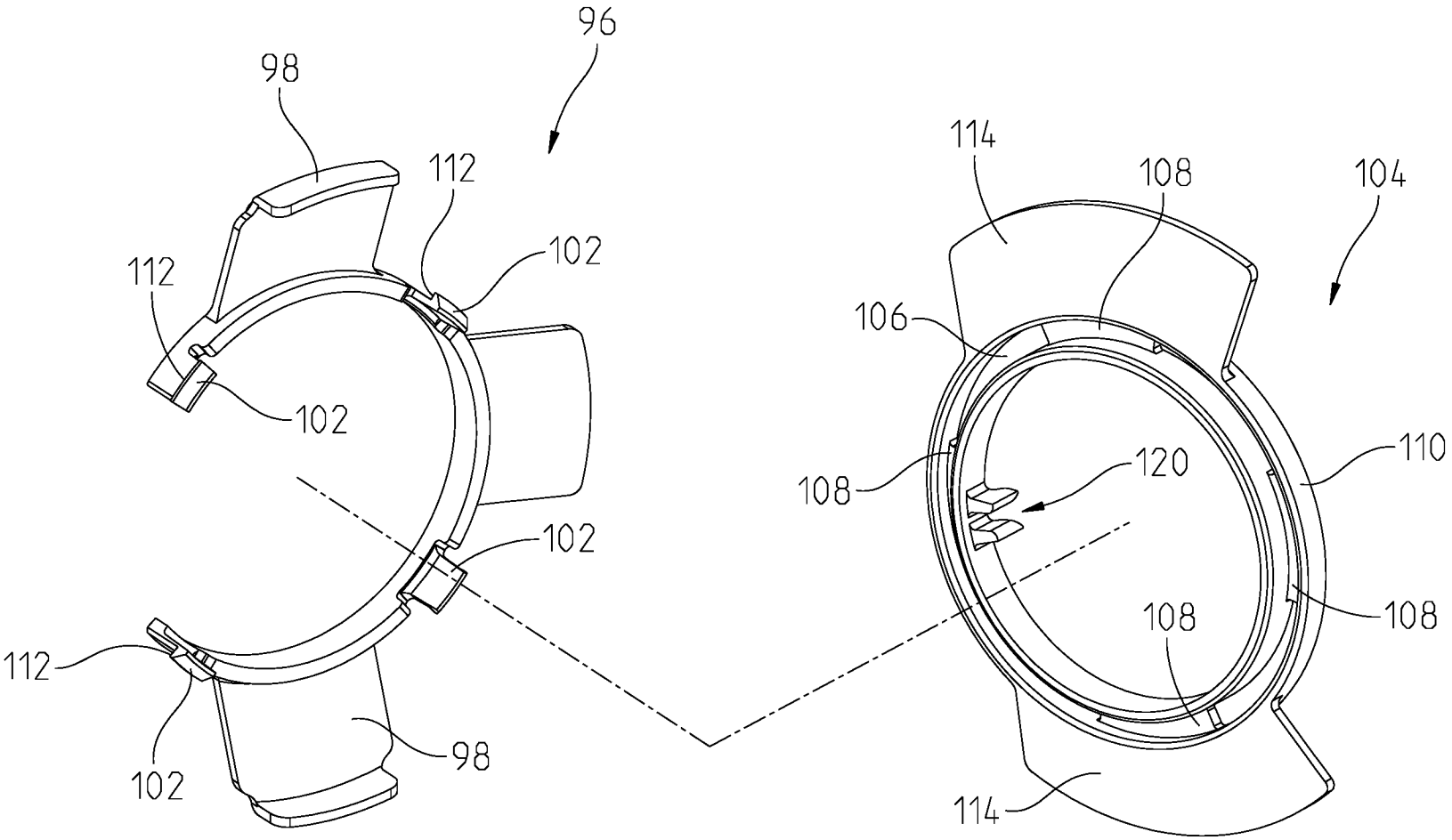
FIG. 3 is an exploded view of an indicator and lens assembly.

Hub 68 (see, e.g., FIGS. 7 and 20) is secured to door 36 (FIG. 2) both rotationally and translationally relative to longitudinal axis 52. When locking lug 48 is positioned corresponding to extension of lock button 40 (FIG. 17), locking lug 48 is free to rotate within arcuate groove 70 (FIG. 7) in hub 68. When locking lug 48 is translated axially along longitudinal axis 52 to the position corresponding to retraction of lock button 40 (FIG. 18), it is moved axially out of arcuate groove 70 and instead engages the walls forming longitudinal slot 72 (FIG. 20). In this position (corresponding to retraction of lock button 40), locking lug 48 is constrained from rotating by the walls forming longitudinal slot 72 in hub 68. In this position, locking lug 48 is similarly constrained from rotating relative to control sleeve 66. Control sleeve 66 is constrained for rotation with ingress handle 34 and; therefore, ingress handle 34 is blocked from receiving a user input sufficient to actuate latch bolt 38 in this position of locking lug 48.

Figure 16:
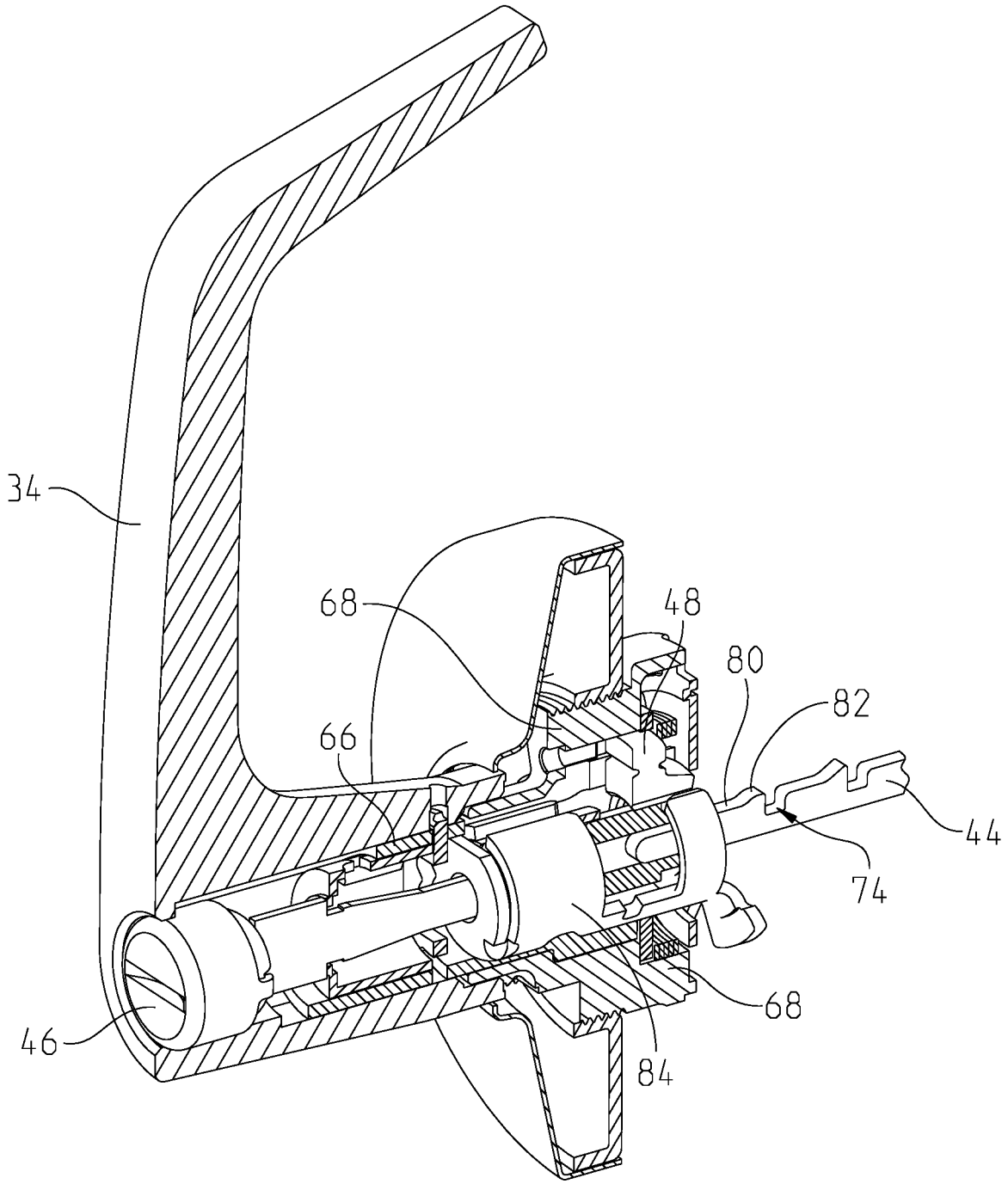
FIG. 16 is a perspective, section view of an outside lock assembly of a privacy function door lock without the indicator assembly of the present disclosure.
Figure 20A:
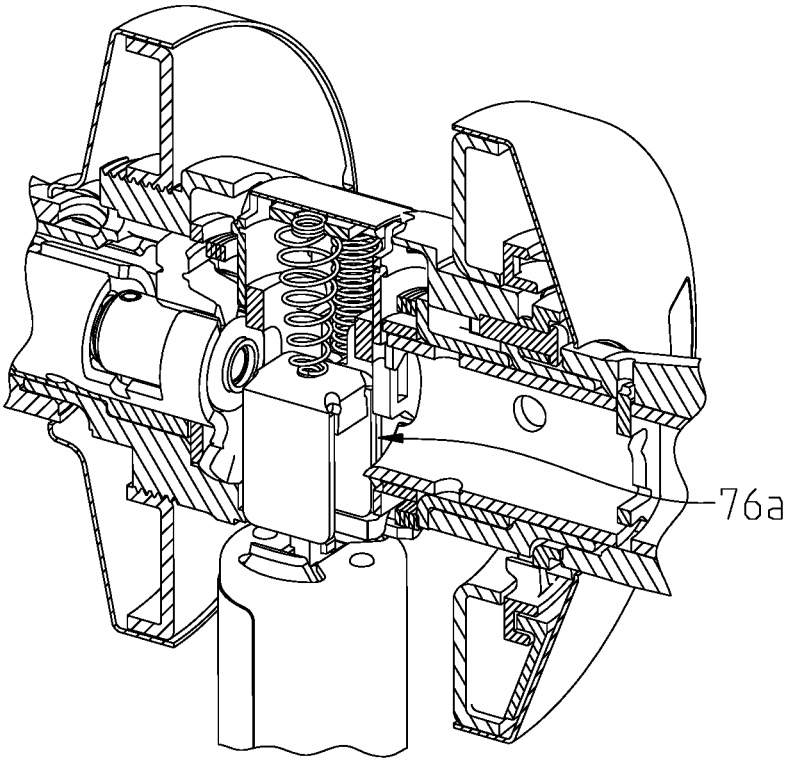
FIGS. 20A and 20B are partial perspective, sectional views of an alternative button bar catch.
Figure 20B:
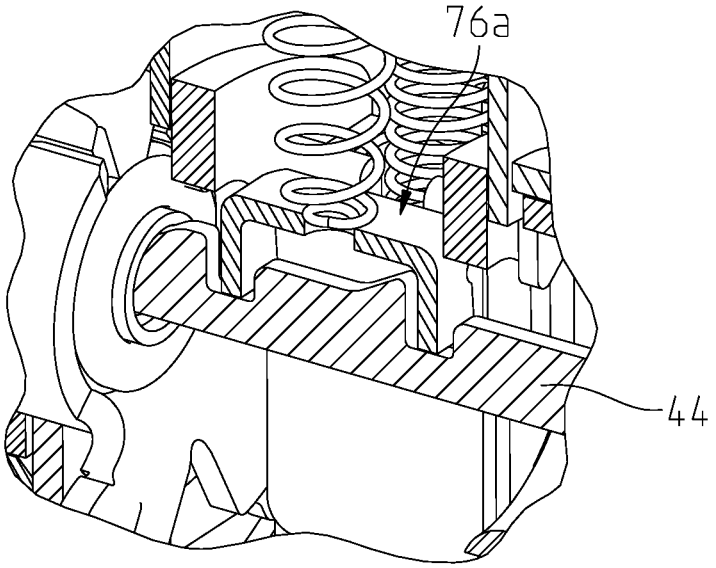

Button bar 44 includes locking slot 74, as illustrated, e.g., in FIGS. 15, 16 and 20. When lock button 40 is depressed from its extended position (FIG. 17) to its retracted position (FIG. 18), catch 76 (which is biased into engagement with button bar 44 by compression spring 78) rides along flat 80, over ramp 82 and into engagement with locking slot 74, as shown in FIG. 20. In the alternative arrangement depicted in FIGS. 20A and 20B, catch 76*a* includes two engagement features engageable in cooperating pair of locking slots in button bar 44. With catch 76 (or 76*a*) engaged with button bar 44, the lock (entry function door lock 30 or privacy function door lock 60) maintains its locked condition. The outside lock input (keyed lock apparatus of entry function door lock 30 or unlock button 46 of privacy function door lock 60) or egress handle 32 can be actuated to translate catch 76 against the biasing force of compression spring 78 and out of locking slot 74 of button bar 44, in conventional fashion. Release cam 84 can be actuated by the outside lock input (keyed lock apparatus of entry function door lock 30 or unlock button 46 of privacy function door lock 60) to effect translation of catch 76 against the biasing force of compression spring 78, for example. When catch 76 exits locking slot 74, compression spring 62 and compression spring 42 cooperate to bias lock button 40 and button bar 44 (and any other components axially secured thereto) back to the extended position of lock button 40, corresponding to the unlocked state of the lock (entry function door lock 30 or privacy function door lock 60).

With reference to FIGS. 3-6, 10-13, 17-19 and 22, the lock indicator of the present disclosure will now be described. The transverse aperture through door 36 through which cylindrical lock 30, 60 is installed is covered on the inside and the outside by a rose 86, which is secured stationary relative to door 36. In the present disclosure, rose 86 is utilized to display an indicator of the lock or unlock status of the lock 30, 60 to which it is secured. In the case of entry function door lock 30, the indicator is visible on the inside of the lock, i.e., from the rose 86 associated with egress handle 32. In the case of privacy function door lock 60, the indicator is visible on the outside of the lock, i.e., from the rose 86 associated with ingress handle 34. Although the present disclosure is exemplified by indicators on one of the inside and outside, if desired, both inside and outside status indicators could be utilized on the same lock.

Figure 4:
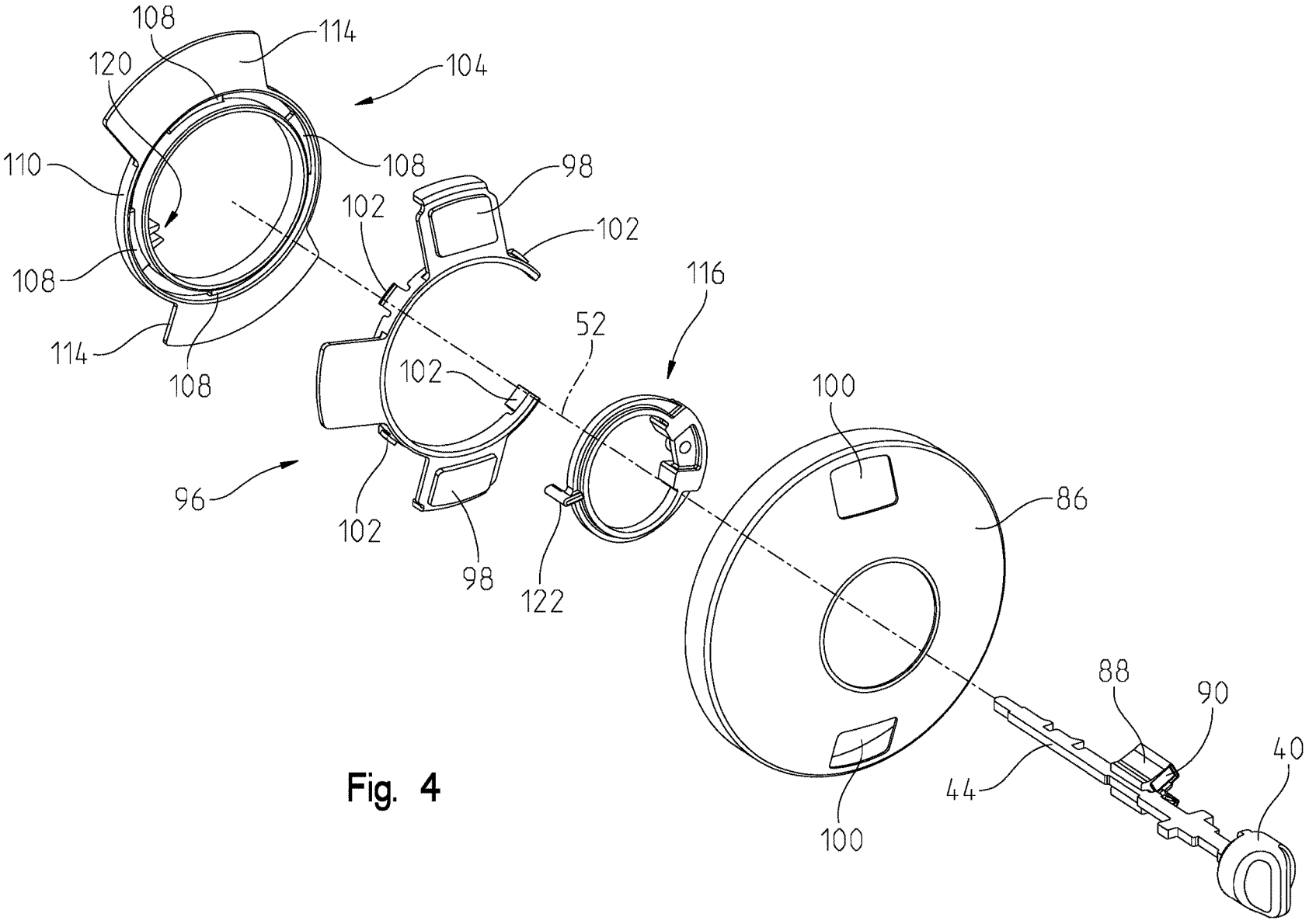
FIG. 4 is an exploded view of an indicator assembly of the present disclosure.
Figure 11:
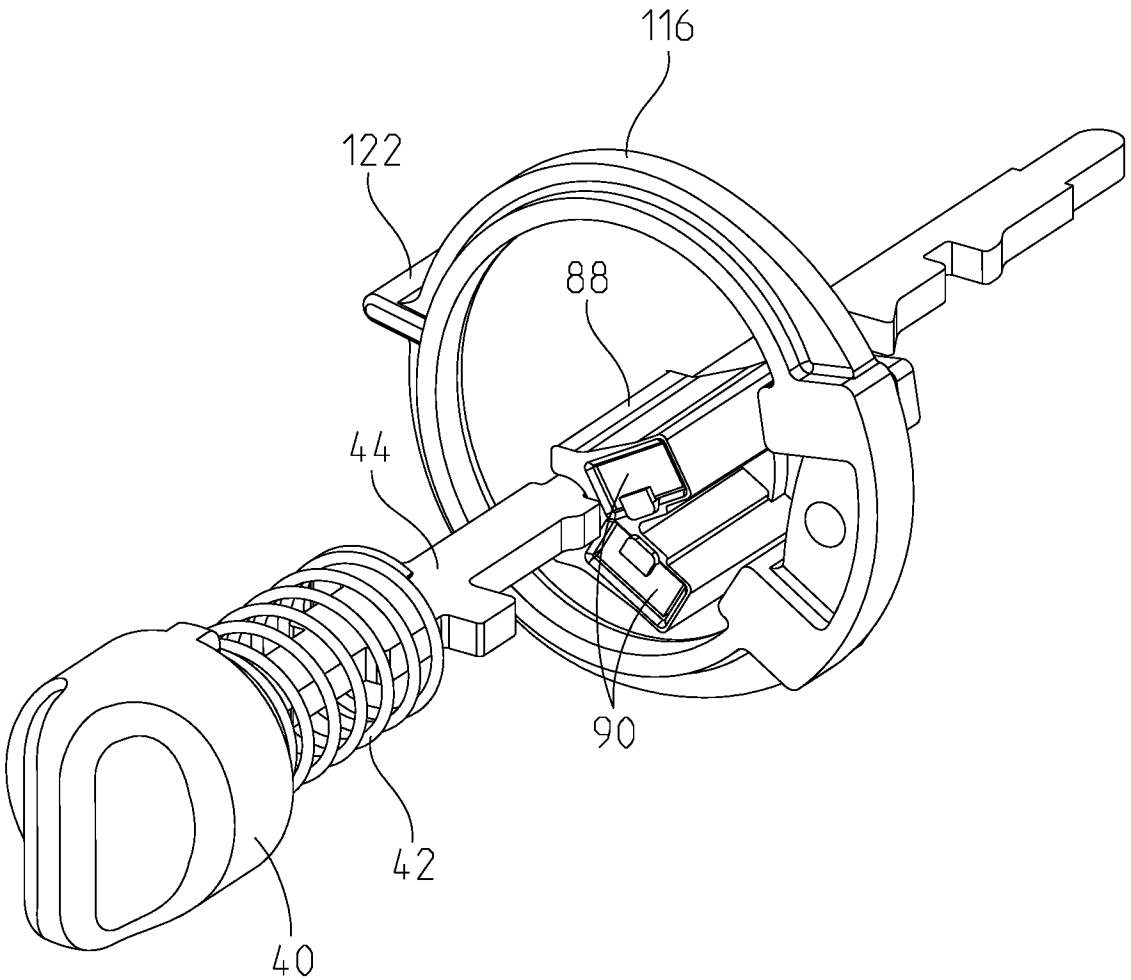
FIG. 11 is a perspective view of an indicator actuator assembly in accordance with the present disclosure.

FIGS. 4-6, 10, 11, 17 and 18 illustrate components of entry function door lock 30. Referring to FIGS. 4 and 11, magnet holder 88 is axially secured to button bar 44, i.e., magnet holder 88 moves along longitudinal axis 52 (FIG. 4) together with button bar 44. Magnet holder 88 carries magnets 90 (FIG. 13), which will be utilized to actuate the status indicators of the present disclosure, as further described below. Button bar 44 is free to rotate relative to magnet holder 88 so that lock button 40 (and button bar 44 therewith) can be rotated 90 degrees to maintain the locked condition, as is conventional in the art. Referring to FIGS. 17 and 18, sleeve 92 includes slots 94 into which magnet holder 88 is positioned. Slots hold the rotational position of magnet holder 88 about longitudinal axis 52.

Referring, e.g., to FIG. 4, lens 96 is secured to rose 86, with windows 98 protruding through window apertures 100. An adhesive may be employed to effect such securement. With lens 96 secured to rose 86, retainers 102 are available to axially fix indicator 104 thereto. Indicator 104 includes annular groove 106, into which retainers 102 can be inserted between stops 108. To insert retainers 102 into annular groove 106, outer ring 110 radially inwardly displaces retainers as it rides over the ramped surfaces at the distal ends of retainers 102. After these ramped surfaces clear outer ring 110, retainers 102 spring back (radially outwardly) to their positions prior to displacement by outer ring 110. At this point, indicator 104 is trapped between windows 98 and stop surfaces 112 of retainers 102 to prevent axial displacement of indicator 104 relative to lens 96. In this position, indicator 104 is rotatable relative to lens 96 within a range of motion defined by retainers 102 and stops 108.

Indicator 104 includes flags 114 corresponding to windows 98. Each flag 114 includes a locked status indicator and an unlocked status indicator, only one of which is visible through windows 98 at each at rest position of indicator 104, which will be further explained below. The locked status indicator and unlocked status indicator of each flag 114 is positioned such that both windows 98 will display the same status indicator (i.e., locked or unlocked) at each at rest position of indicator 104. The locked status indicator may be a graphical indicator and/or a color indicator. Similarly, the unlocked status indicator may be a graphical indicator and/or a color indicator. For example, the unlocked status indicator may be a green portion of each flag 114, while the locked status indicator may be a red portion of each flag 114.

Rocker 116 is operable to actuate indicator 104 between indicating a locked condition and an unlocked position of lock 30, 60. Referring, e.g., to FIG. 10, rocker 116 is pivotally connected to the chassis of lock 30, 60 by pivot pin 18. With rocker 116 pivotally secured to the lock chassis, and indicator 104 secured to rose 86 via lens 96, yoke 120 can be aligned with pin 122 of rocker 116 to allow rose 86 to be secured relative to door 36 with indicator 114 operably positioned. Indicator 114 is operably positioned with pin 122 of rocker 116 trapped by yoke 120 of indicator 104 such that pivoting of rocker 116 about pivot pin 18 causes rotation of indicator 104 about lens 96.

Figure 6:
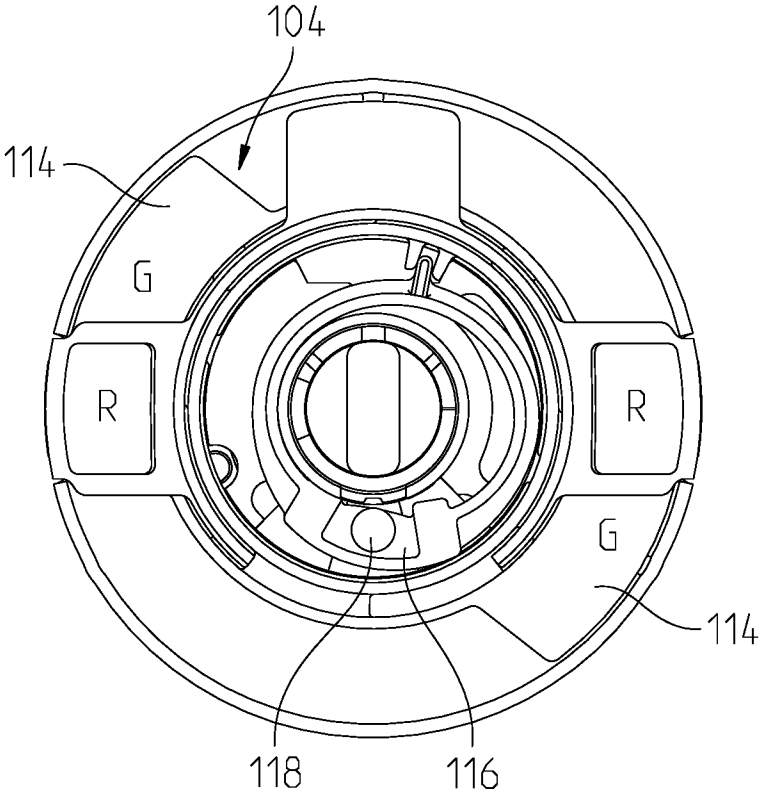
FIG. 6 is an axial end elevational view illustrating an indicator in the lock position with the rose removed for clarity.
Figure 5:
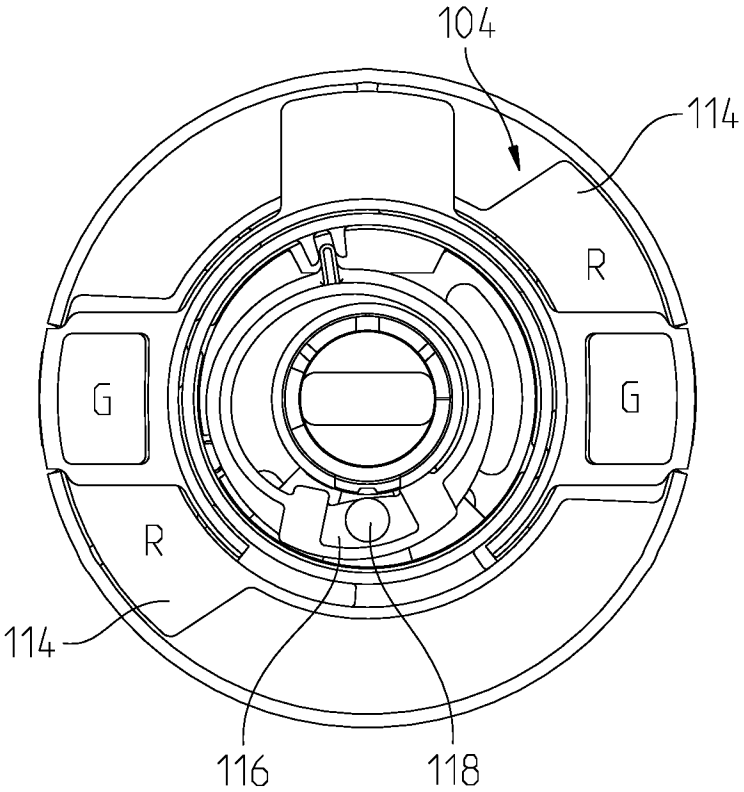
FIG. 5 is an axial end elevational view illustrating an indicator in the unlock position with the rose removed for clarity.
Figure 7:
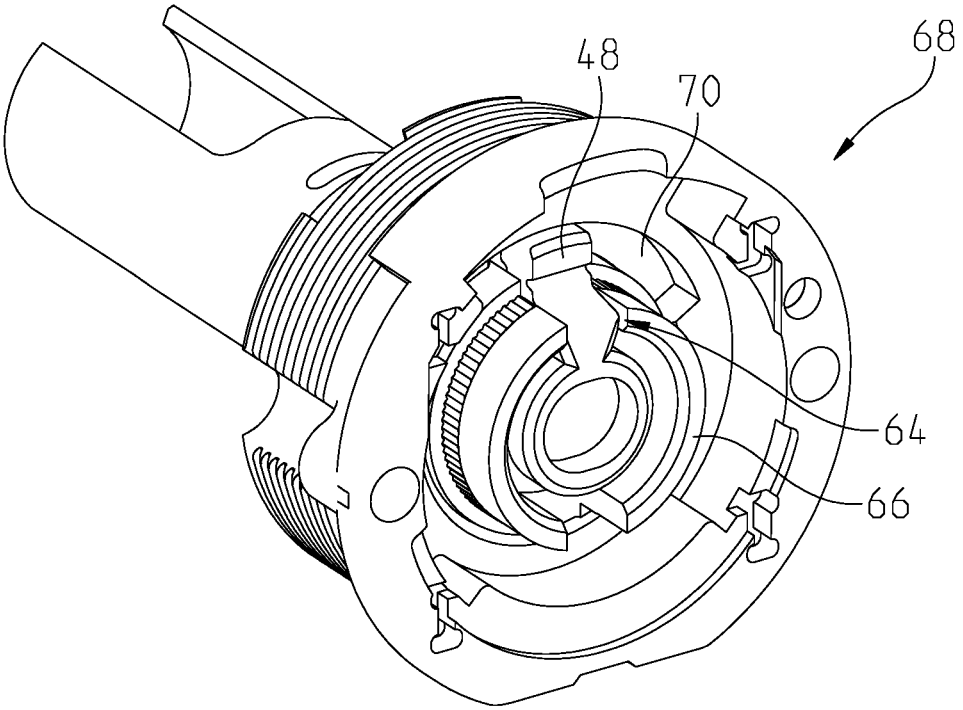
FIG. 7 is a perspective view of a hub and locking lug assembly.
Figure 8:
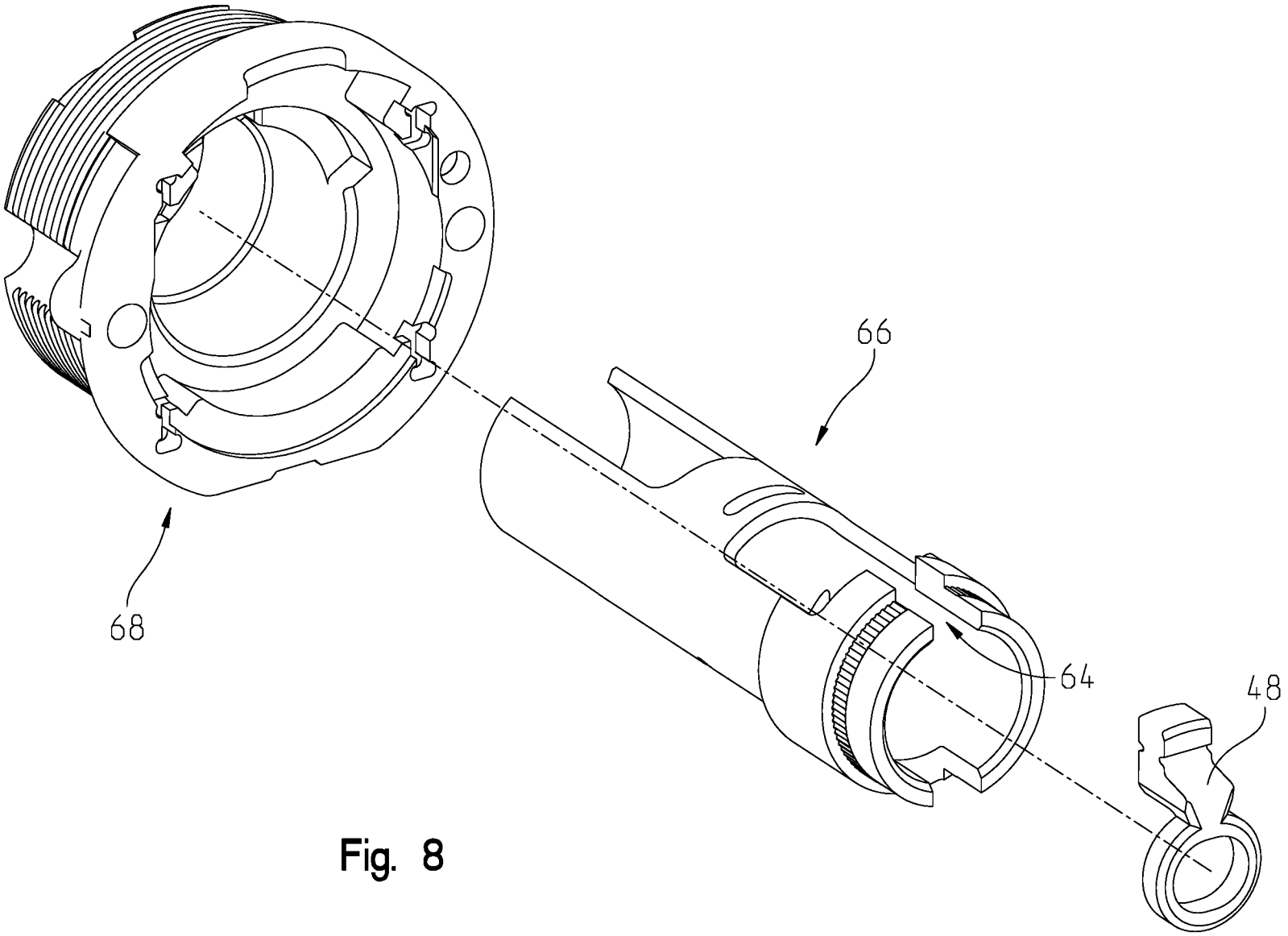
FIG. 8 is an exploded, perspective of the components illustrated in FIG. 7.
Figure 9:
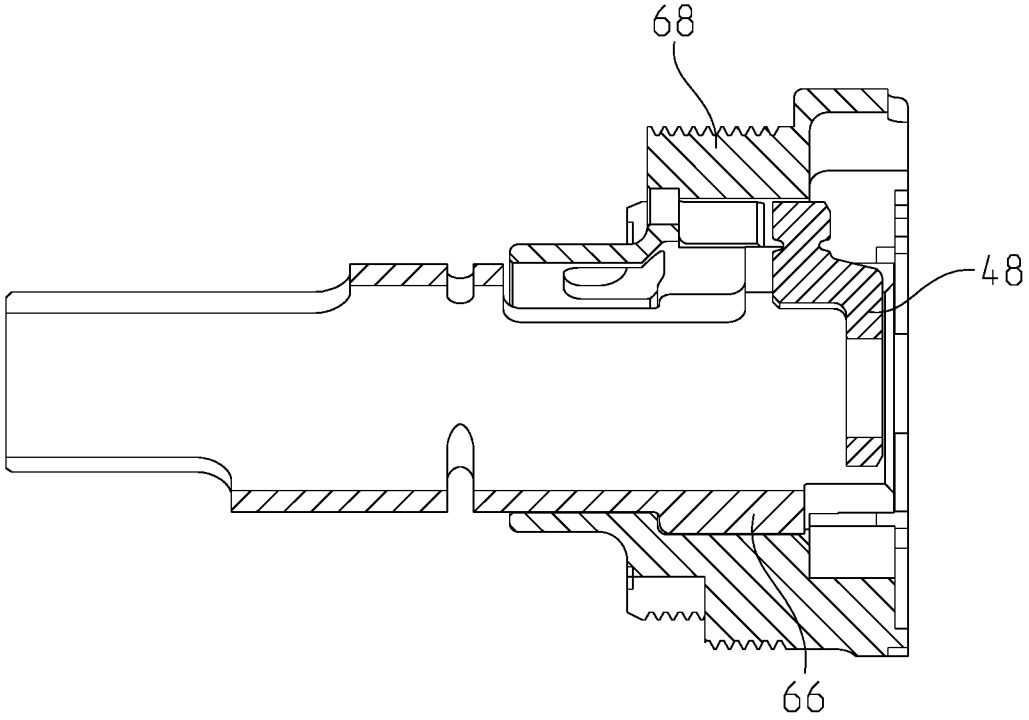
FIG. 9 is a radial elevation view of the assembly of FIGS. 7 and 8.
Figure 10:
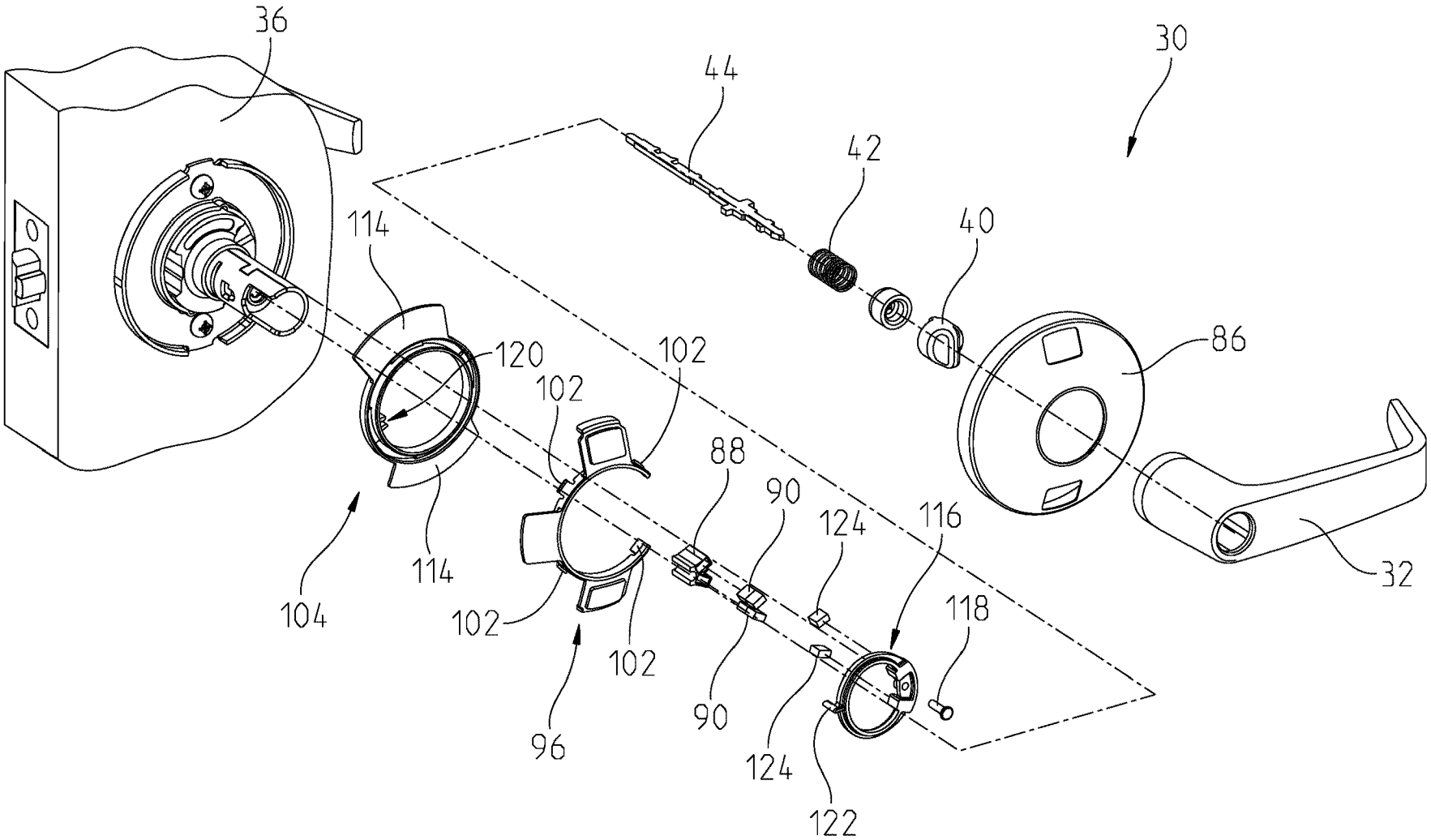
FIG. 10 is an exploded, perspective view of an entry function door lock incorporating the indicator of the present disclosure.

FIGS. 5 and 6 illustrate the operable arrangement of rocker 116 and indicator 104, with rose 86 removed. FIG. 5 illustrates indicator 104 in the unlocked indication position, with green areas G of flags 114 positioned beneath and viewable through windows 98. From this position, rocker 116 can be pivoted about pivot pin 18, as will be further described herein below, to the position illustrated in FIG. 6. Such pivoting of rocker 116 causes a responsive rotation of indicator 104. Particularly, with pin 122 of rocker 116 trapped in yoke 120 of indicator 104, displacement of pin 122 from the position illustrated in FIG. 5 to the position illustrated in FIG. 6 causes a rotation of indicator 104 from the unlocked indication position illustrated in FIG. 5 to the locked indication position illustrated in FIG. 6. In the locked indication position, red areas R of flags 114 are positioned beneath and viewable through windows 98. Rotation of indicator 104 between the positions illustrated in FIGS. 5 and 6 is guided by cooperation of outer ring 110 and stops 108 of indicator 104 with retainers 102 of lens 96, as described above.

Rocker 116 carries magnets 124 (FIG. 10) which cooperate with magnets 90 of magnet holder 88 to effect movement of indicator 104 between the locked indication position and the unlocked indication position illustrated in FIGS. 6 and 5, respectively. Magnets 124 are aligned with magnets 90 such that the magnetic force of magnets 124, 90 will position rocker 116 in one of the positions illustrated in FIGS. 5 and 6, depending on the position of lock button 44 (i.e., either extended or retracted). As illustrated in FIG. 17, magnets 90 in magnet holder 88 present two negative magnet poles adjacent to rocker 116 in the extended position of lock button 40. Referring to FIG. 18, magnets 90 in magnet holder 88 present two positive poles adjacent to rocker 116 in the retracted position of lock button 40. Magnets 124 carried by rocker 116 present one radially inward positive pole and one radially inward negative pole. With this arrangement of magnets, one magnet 124 carried by rocker 116 is magnetically attracted toward magnet holder 88, while the other magnet 124 carried by rocker 116 is magnetically repelled away from magnet holder 88. The attraction and repulsion are reversed depending on whether lock button 40 is extended or retracted.

The exemplification of the disclosure described above relies on the particular arrangement of magnets described above; however, alternative arrangements will also work. For example, magnets 124 carried by rocker 116 may present the same (both positive, or both negative) poles radially inwardly and adjacent to magnet holder 88, in which case, magnet holder 88 would present one positive and one negative pole radially outwardly adjacent to rocker 116. The position of the positive and negative poles presented by magnet holder 88 radially outwardly and adjacent to rocker 116 would be reversed from the position illustrated in FIG. 17 to the position illustrated in FIG. 18. While these alternatives would function to properly display the lock status with egress handle 32 at rest, problems could arise when egress handle 32 was actuated. This is because rotation of egress handle 32 causes rotation of sleeve 92.

With the reference of looking at lock button 40 and subsequently door 36, egress handle 32 (and with it, sleeve 92) can be rotated either clockwise or counterclockwise to actuate latch bolt 38. If egress handle 32 (and sleeve 92) is rotated clockwise, the negative magnet on rocker 116 will be rotated away from the associated negative magnet held by magnet holder 88, while the positive magnet held by rocker 116 will be positioned adjacent to and attracted to the magnetized metal of steel sleeve 92 spanning the negative magnets of magnet holder 88 and then adjacent to the second negative magnet held by magnet holder 88. In this way, the positive magnet attraction establishing the position of rocker 116 illustrated in FIG. 17 will be maintained through actuation of egress handle 32 to actuate latch bolt 38. Similarly, if egress handle 32 (and sleeve 92) is rotated counterclockwise, the positive magnet on rocker 116 will be rotated away from the associated negative magnet held by magnet holder 88, while the negative magnet held by rocker 116 will be positioned adjacent to and repelled by the magnetized metal of steel sleeve 92 spanning the negative magnets of magnet holder 88 and then to the second negative magnet held by magnet holder 88. In this way, the magnet repulsion establishing the position of rocker 116 illustrated in FIG. 17 will be maintained through actuation of egress handle to actuate latch bolt 38.

Figure 13:
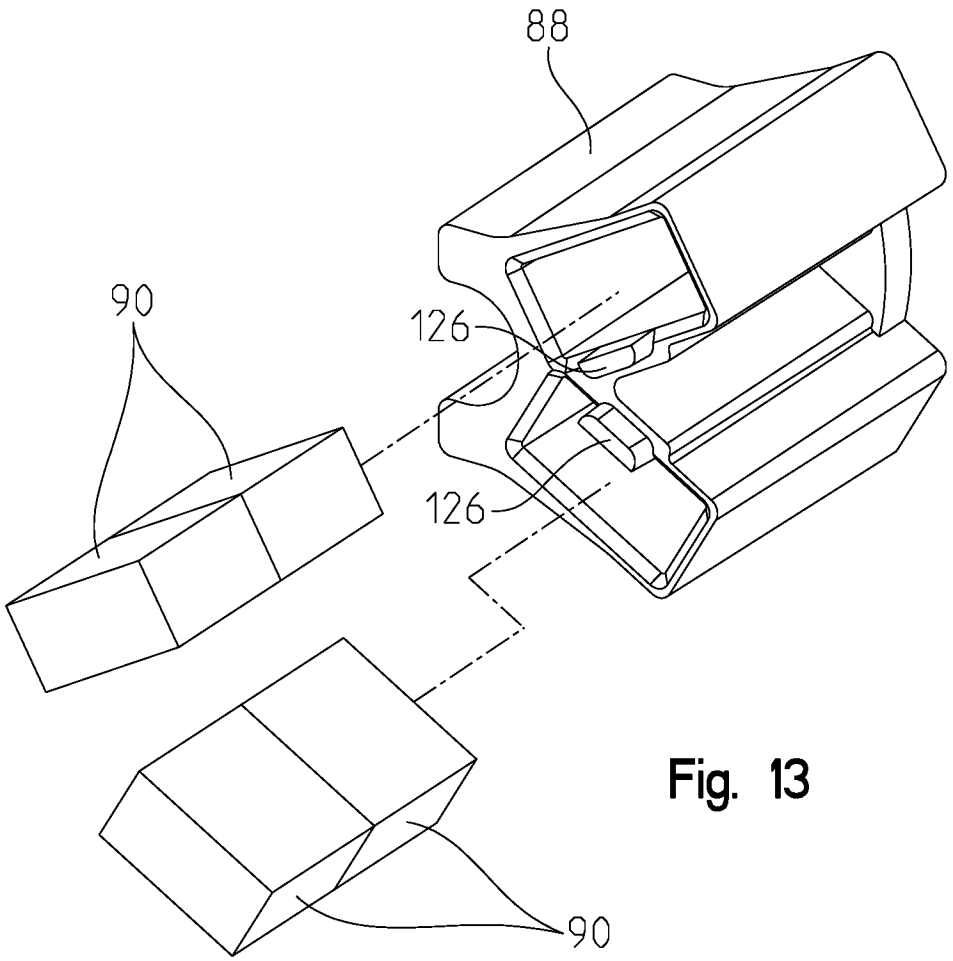
FIG. 13 is an exploded, perspective view of the magnet holder of FIG. 12 and its associated magnets.
Figure 12:
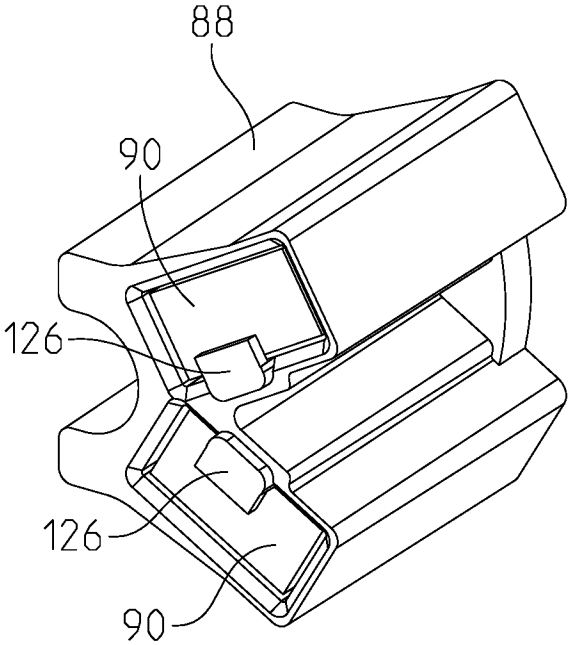
FIG. 12 is a perspective view of a magnet holder.
Figure 14:
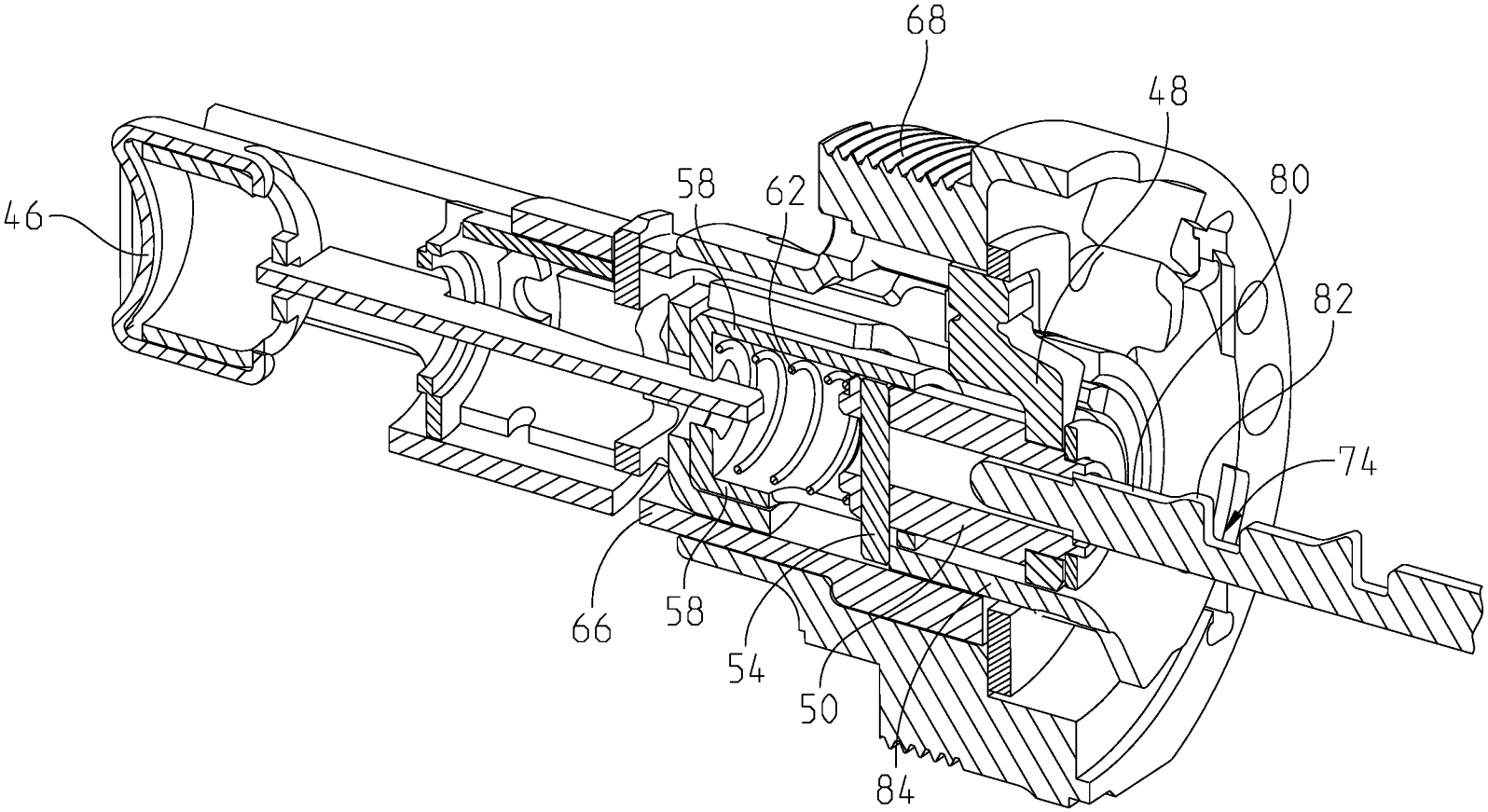
FIG. 14 is a perspective, section view of the outside unlock assembly of a privacy function door lock.

FIGS. 12 and 13 illustrate magnet holder 88 and magnets 90 in detail. Magnet holder 88 includes two spaced channels, each sized to receive magnets 90. The pair of magnets 90 received in each channels of magnet holder 88 will positioned with their polarities reversed to effect the actuation of indicator 104 described in detail above. Swaging bosses 126 may be utilized to secure magnets 90 in magnet holder 88 as shown in FIG. 12. Alternatively, adhesive or a press-fit may be utilized to secure magnets 90 in magnet holder 88. Magnet holder 88 is, in the illustrated exemplifications of the disclosure, a plastic part.

Figure 21:
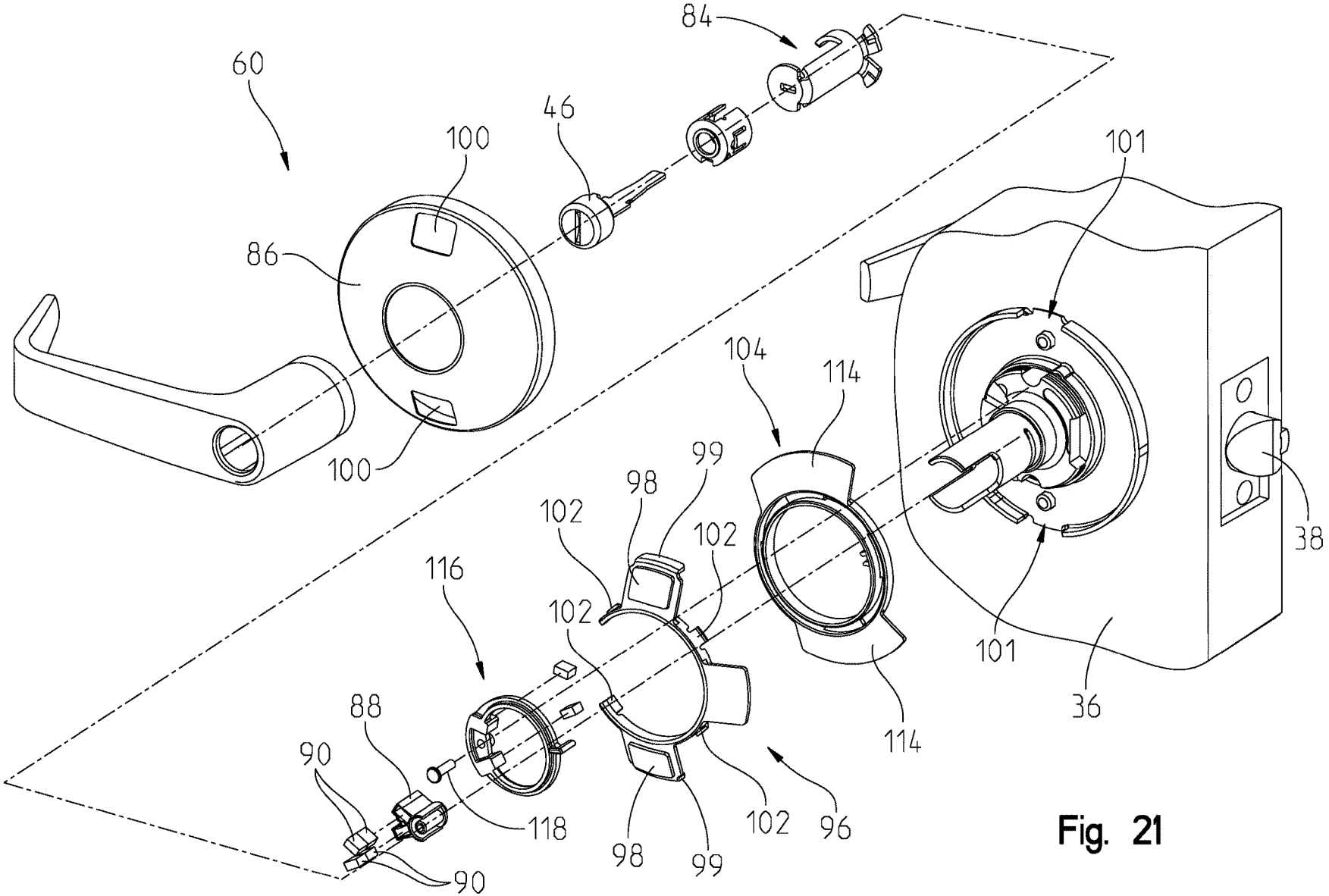
FIG. 21 is an exploded, perspective view of an outside indicator assembly of the present disclosure implemented on a privacy function door lock.

To this point, the indicator function of the present disclosure has been described with respect to entry function door lock 30, i.e., with an inside indication of the lock/unlock status of lock 30. A similar arrangement of parts can be used to provide an outside indication of the lock/unlock status of, e.g., privacy function door lock 60. Referring to FIG. 21, rose 86 featuring window apertures 100 is exemplified as the outside rose. Lens 96 and indicator 104 are secured to rose 86 in the same way as described above with respect to entry function door lock 30. As shown in FIG. 21, lens 96 includes tabs 99 extending axially from windows 98. These tabs 99 are placed in slots 101 interrupting the outer radial ridge of the lock base secured to door 36. Rocker 116 is similarly pivotally supported by pivot pin 118 secured to the lock chassis. On the outside of lock 30, 60, axial translation of button bar is translated into axial displacement of release cam 84, which axially constrains magnet holder 88. Otherwise, the indicator assembly functions in the same way as described above with respect to entry function door lock 30.

FIGS. 22-41 illustrate intruder function door lock 130. As illustrated, intruder function door lock 130 is exemplified as a cylindrical lock. As mentioned above, cylindrical locks are well known in the art; therefore, in the description that follows only certain details of the exemplary locks are described in detail, with the detailed description instead focusing on the indicator apparatus and associated method of use.

Figure 22:
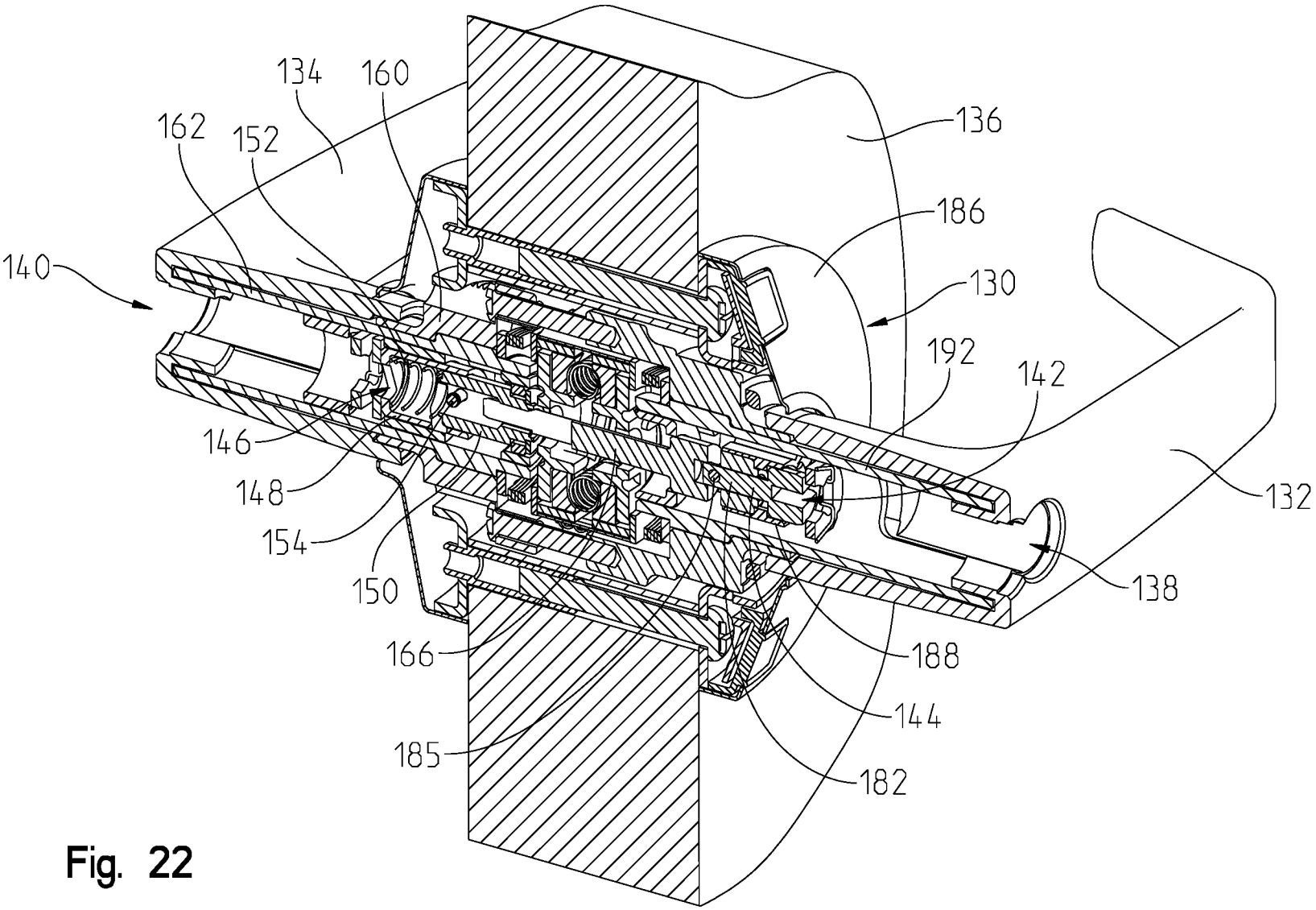
FIG. 22 is a perspective, sectional view of an intruder function door lock of an embodiment of the present disclosure.

As illustrated in FIG. 22, intruder function door lock 130 includes an egress actuator exemplified as egress handle 132. Intruder function door lock 130 further includes an ingress actuator exemplified as ingress handle 134. Intruder function door lock 130 is operably coupled to door 136. Door 136 is, in use, arranged to selectively allow and disallow ingress and egress from an area selectively covered by door 136. In an exemplification, door 136 can be hinged to a doorframe and can be selectively secured thereto by a latch bolt similar to latch bolt 38 described above and depicted in FIGS. 1, 2, 10, and 21 above, as is well known in the art.

Intruder function door lock 130 is an intruder lock, which means that it is actuated between the locked and the unlocked states by keys insertable for use through both egress handle 132 and ingress handle 134. Like the entrance and privacy locks described above, egress handle 132 is always unlocked.

In an unlocked state of intruder function door lock 130, both egress handle 132 and ingress handle 134 can be actuated by an operator input motion to move the associated latch bolt from its extended position (see e.g, FIG. 1 for an illustration of an extended latch bolt associated with an alternative cylindrical lock, i.e., entry function door lock 30) to a retracted position allowing ingress and egress through door 136. When one of egress handle 132 and ingress handle 134 is actuated to move the associated latch bolt to the retracted position, door 136 can be moved relative to its doorframe to allow ingress and egress therethrough. Mechanisms for translating rotation of ingress handle 134 (and egress handle 132) into reciprocation of a latch bolt are well known in the art and are not here explained for the sake of brevity. In its simplest form such a mechanism can take the form of a cam rotated by ingress handle 134 (if the lock is in its unlocked state) or egress handle 132 to reciprocate the associated latch bolt between its extended and retracted positions.

Intruder function door lock 130 includes a keyed inside lock input and a keyed outside lock input (otherwise known as egress and ingress locks, respectively), which can both be exemplified as a small format interchangeable core (SFIC). Both the inside lock input and the outside lock input can be keyed to a physical key or to an electronic key. In any event, a specialized input (i.e., a key) is needed to utilize the inside lock input and/or the outside lock input to actuate intruder function door lock 130 between its locked condition (in which ingress handle 134 is blocked from receiving an operator input motion to move the latch bolt associated therewith) and its unlocked condition (in which ingress handle 134 is able to transmit an operator input motion to reciprocation of the latch bolt associated therewith). As indicated above, mechanisms for translating rotation of an ingress handle and/or an egress handle into reciprocation of a latch bolt are well known in the art and are not here explained for the sake of brevity. In its simplest form such a mechanism can take the form of a cam rotated by ingress handle 134 (if the lock is in its unlocked state) or egress handle 132 to reciprocate the latch bolt associated therewith between its extended and retracted positions.

An SFIC can be positioned in lock openings 138, 140 in egress handle 132 and ingress handle 134, respectively, to receive a key input to actuate intruder function door lock 130 as further explained below. The inside and outside lock inputs to intruder function door lock 130 can be keyed to a physical key or to an electronic key. In any event, a specialized input (i.e., a key) is needed to utilize the lock inputs to actuate intruder function door lock from the locked to the unlocked condition. No matter what forms the inputs to the locks associated with egress handle 132 and ingress handle 134, a throw member will form the output of such locks.

At the egress side of intruder function door lock 130, an egress throw member will extend from the lock inserted in lock opening 138 and be engaged in slot 142 in key cam 144 (see, e.g., FIGS. 22-26, 34, and 36). At the ingress side of intruder function door lock 130, an ingress throw member will extend from the lock inserted in lock opening 140 and be engaged in slot 146 of cam 148 (see, e.g., FIGS. 22, 23, 32, and 33). The throw members (and associated locks) will hold key cam 144 and cam 148 against rotation (other than minimal rotation due to tolerancing between the throw members and slots). Rotation of the throw members by their associated locks will cause rotation of key cam 144 and cam 148, but otherwise, key cam 144 and cam 148 will be substantially held against rotation.

Figure 23:
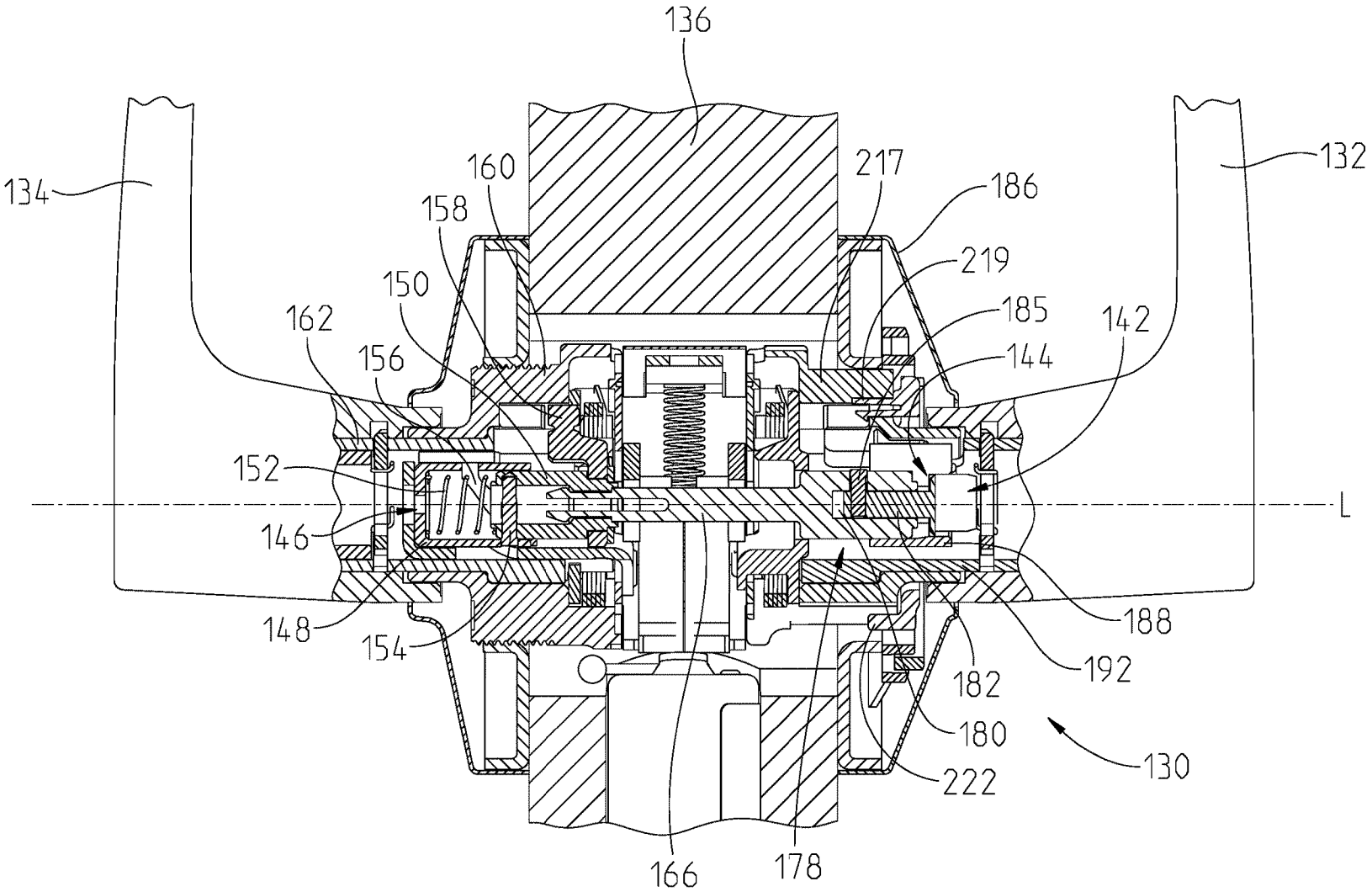
FIG. 23 is a sectional view of the intruder function door lock of FIG. 22.

Actuation of the lock at the ingress side of intruder function door lock 130 will cause rotation of the throw member positioned in cam 148 and thereby cause rotation of cam 148. Cam 148 is positioned in entry function door lock 30 such that it is not axially displaceable (i.e., displaceable along longitudinal axis L shown in FIG. 23). Key release bushing 150 is positioned inside cam 148 as shown in FIGS. 22 and 23. Spring 152 is interposed between key release bushing 150 and cam 148. Guide pin 154 is secured to key release bushing 150 and extends radially (with respect to longitudinal axis L shown in FIG. 23) outwardly therefrom and into helical slot 156 (FIG. 23). Locking lug 158 is secured for axial translation along longitudinal axis L with key release bushing 150, but is rotatable relative thereto. Relative rotation between cam 148 and key release bushing 150 (as will be further described below) causes axial translation of key release bushing. Locking lug 158 is blocked from rotation and; therefore, translation of key release bushing 150 (either through rotation of cam 148 or rotation of key release bushing 150, as further described below) yields axial translation of locking lug 158 between the unlocked position illustrated in FIGS. 23, 29, and 32 and the locked position illustrated in FIG. 33. Locking lug 158 cooperates with hub 160 (see, e.g., FIGS. 22, 23, and 29) and control sleeve 162 (FIGS. 22, 23, 29, and 31-33) to selectively block user input to ingress handle 134 from being able to actuate the latch bolt to allow door 136 to be opened.

Hub 160 is secured to door 136 both rotationally and translationally relative to longitudinal axis L. When locking lug 158 is positioned in the unlocked position illustrated in FIGS. 23, 29, and 32, locking lug 158 is free to rotate within arcuate groove 164 (FIG. 29) in hub 160. When locking lug 158 is translated axially along longitudinal axis L to the locked position shown in FIG. 33, locking lug 158 is moved axially out of arcuate groove 164 and is constrained against rotation about longitudinal axis L by walls of hub 160. In the locked position, locking lug 158 is similarly constrained from rotating relative to control sleeve 66. Control sleeve 66 is constrained for rotation with ingress handle 134 and; therefore, ingress handle 134 is blocked from receiving a user input sufficient to actuate the latch bolt in the locked position of locking lug 158.

Key release bushing 150 is secured to locking bushing bar 166 both rotationally and translationally. As detailed in FIGS. 27 and 28, locking bushing bar 166 features ingress connection end 168 having a geometry allowing locking bushing bar 166 to be snap fit with key release bushing 150. In construction, locking bushing bar 166 is inserted into key release bushing 150, with ramped distal ends 170 flexing toward each other until key release bushing 150 is axially captured between locking head 172 and shoulder 174 of locking bushing bar 166. Key release bushing 150 features internal flats 184 (FIG. 31) cooperating with flats 176 at ingress connection end 168 to rotationally lock key release bushing 150 to locking bushing bar when assembled as illustrated, e.g., in FIG. 23.

Figure 26:
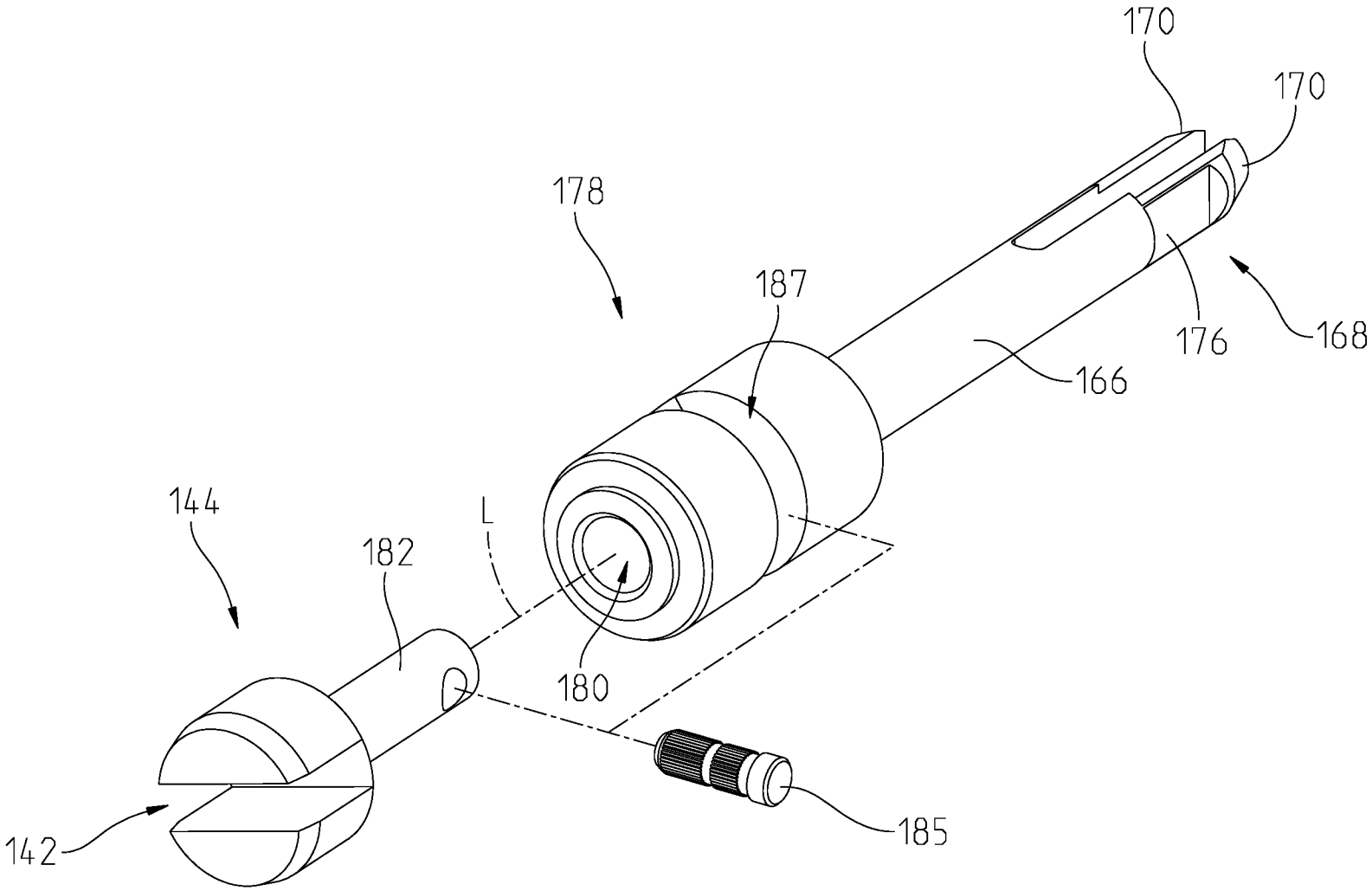
FIG. 26 is an exploded perspective view of the locking bushing bar of FIG. 25.
Figure 27:
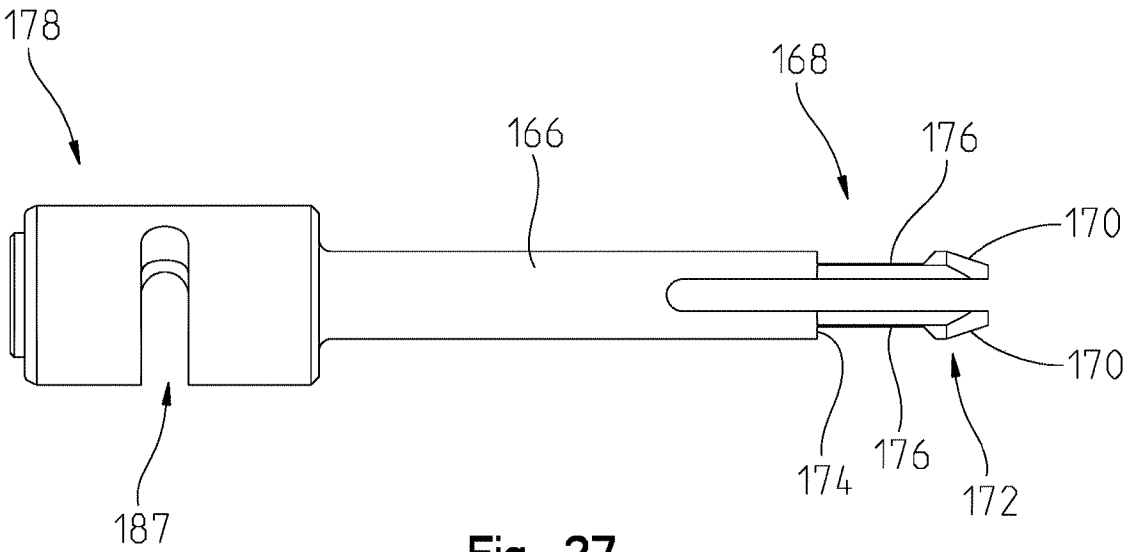
FIGS. 27 and 28 are radial elevational views of the locking bushing bar of FIGS. 25 and 26.
Figure 28:
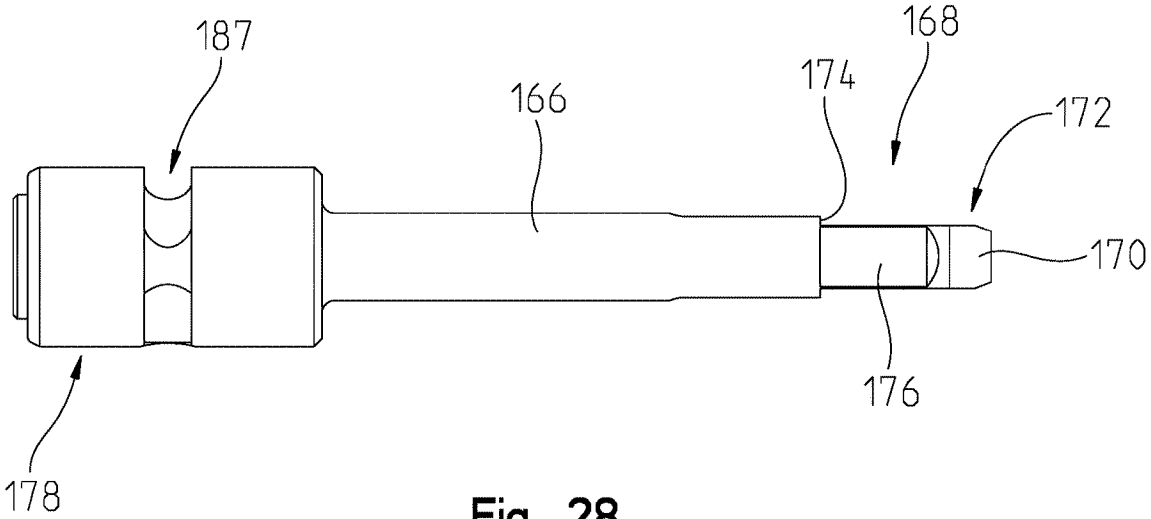
Figure 29:
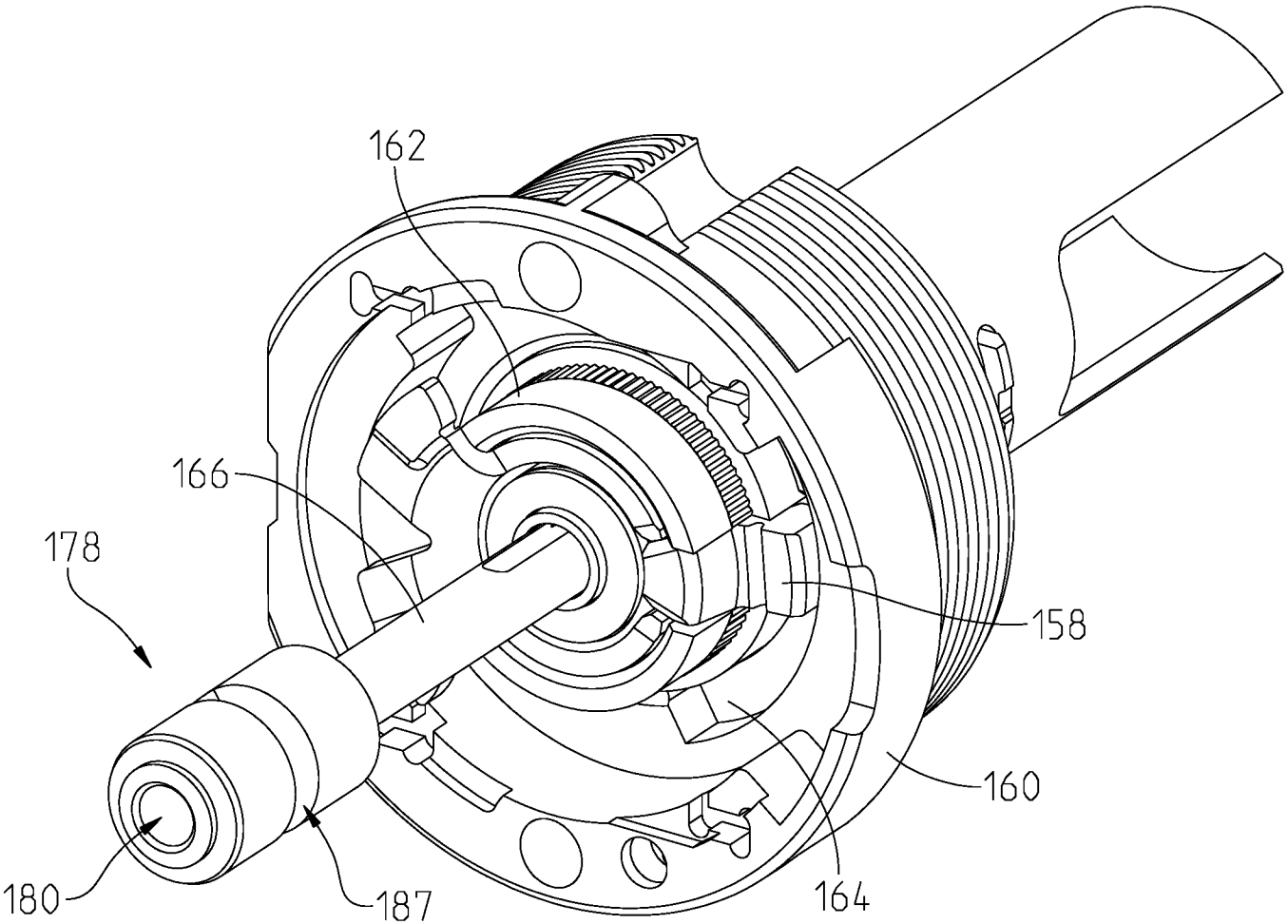
FIG. 29 is a partial perspective view of the ingress side hub of the intruder function door lock of FIGS. 22-25, with the locking bushing bar of FIGS. 25-28 extending therefrom.
Figure 30:
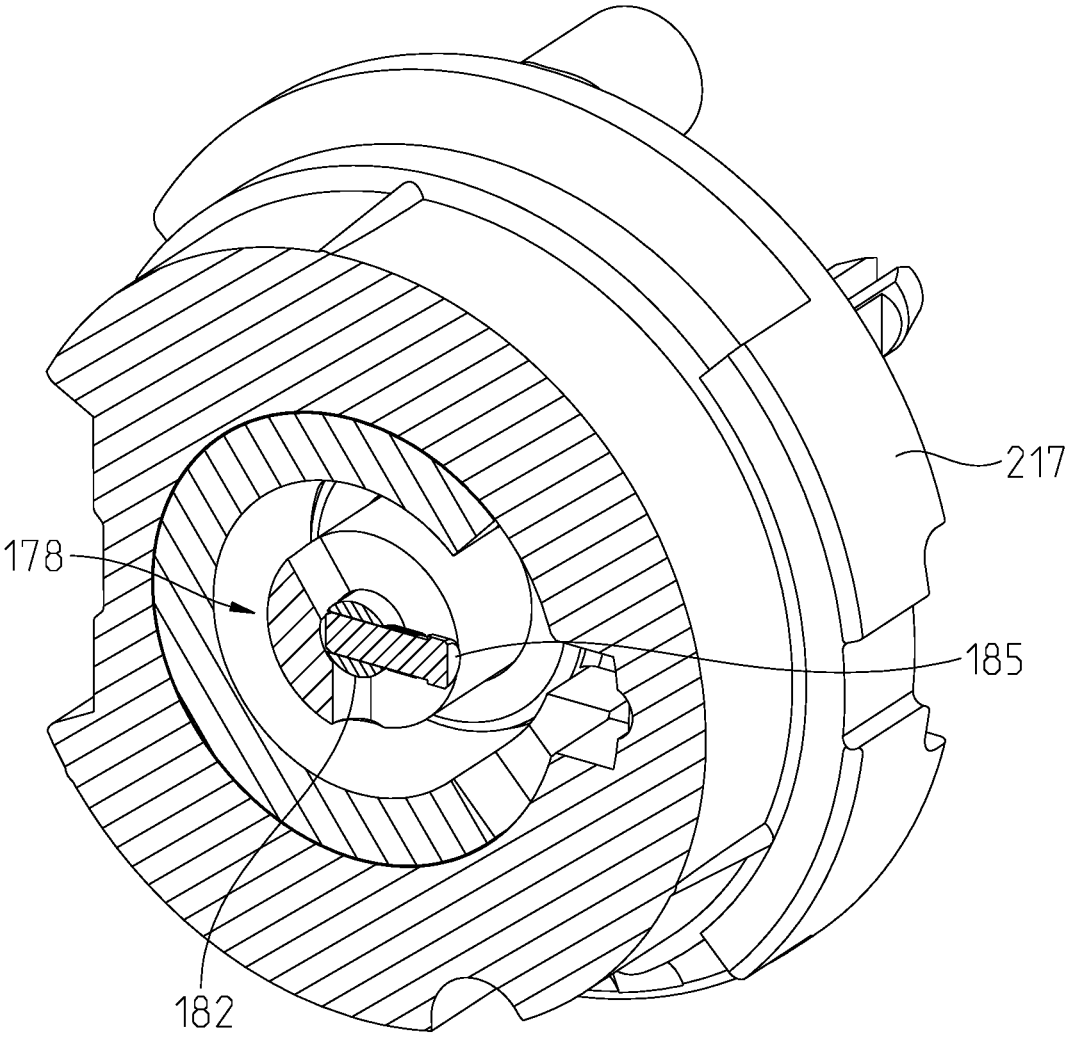
FIG. 30 is a sectional view through the egress hub of the intruder function door lock of FIGS. 22-25.
Figure 31:
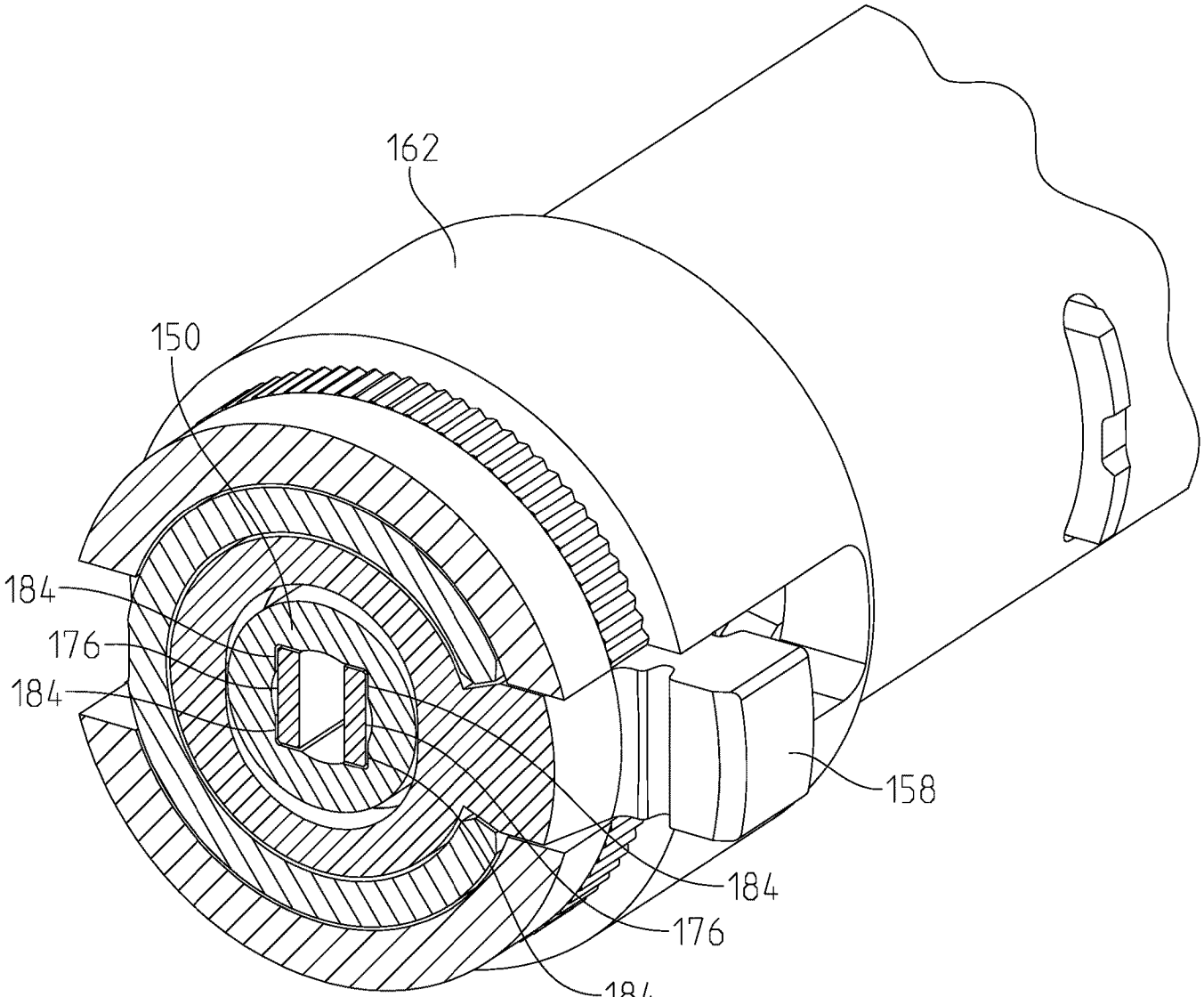
FIG. 31 is a sectional view through the ingress sleeve and locking lug carrier.
Figure 32:
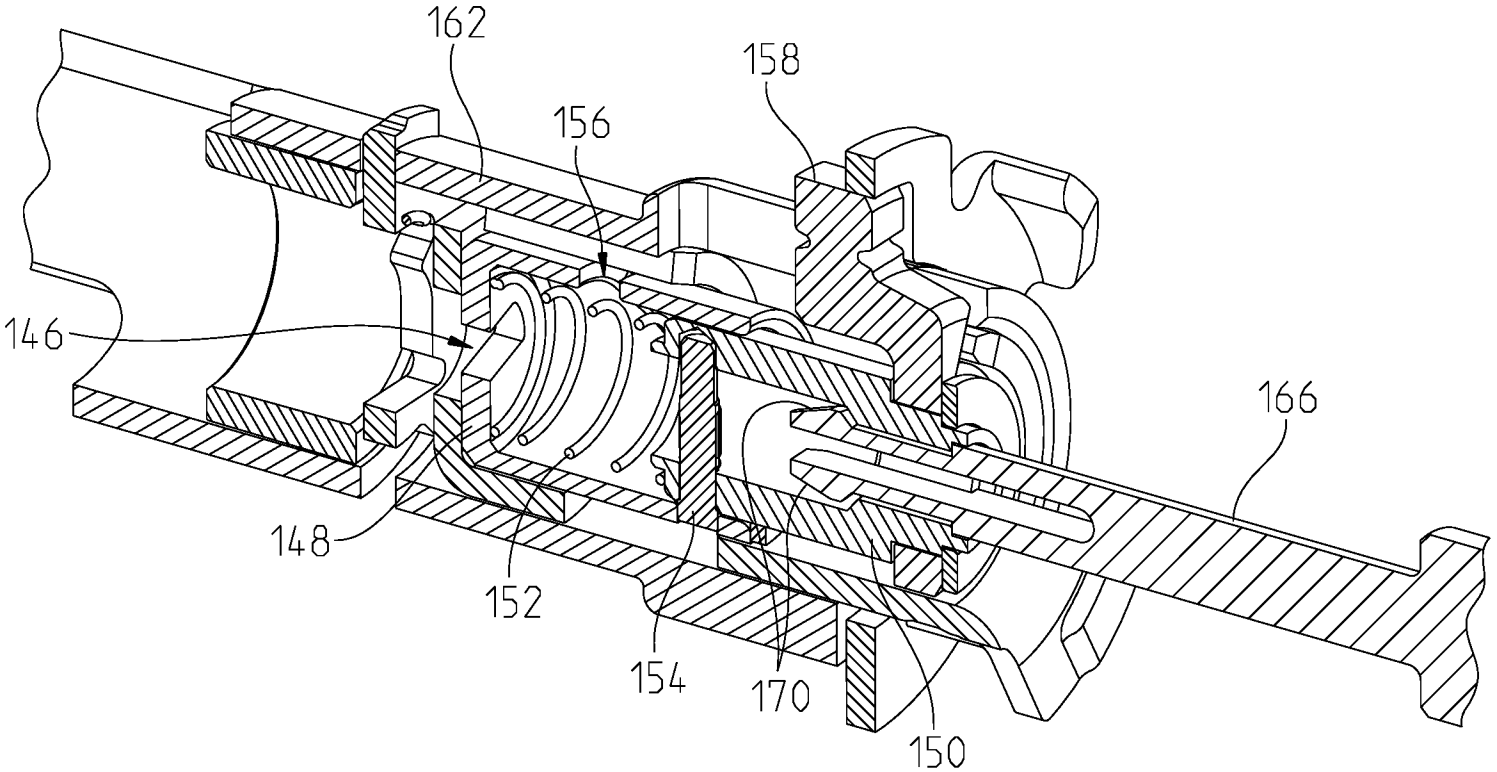
FIG. 32 is an axial sectional view through certain of the ingress side components of the intruder function door lock of FIGS. 22-25, with the locking lug shown in the unlocked position.
Figure 33:
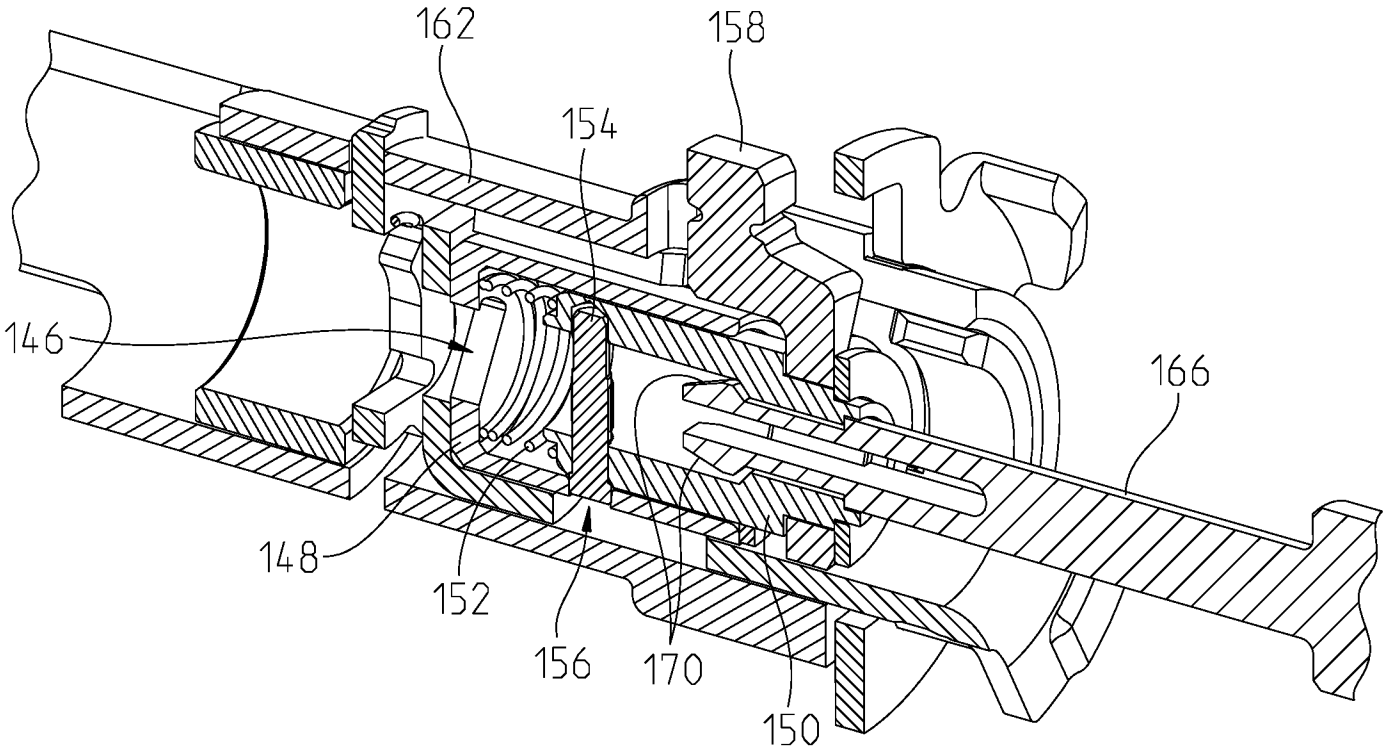
FIG. 33 is an axial sectional view through certain of the ingress side components of the intruder function door lock of FIGS. 22-25, with the locking lug shown in the locked position.
Figure 35:
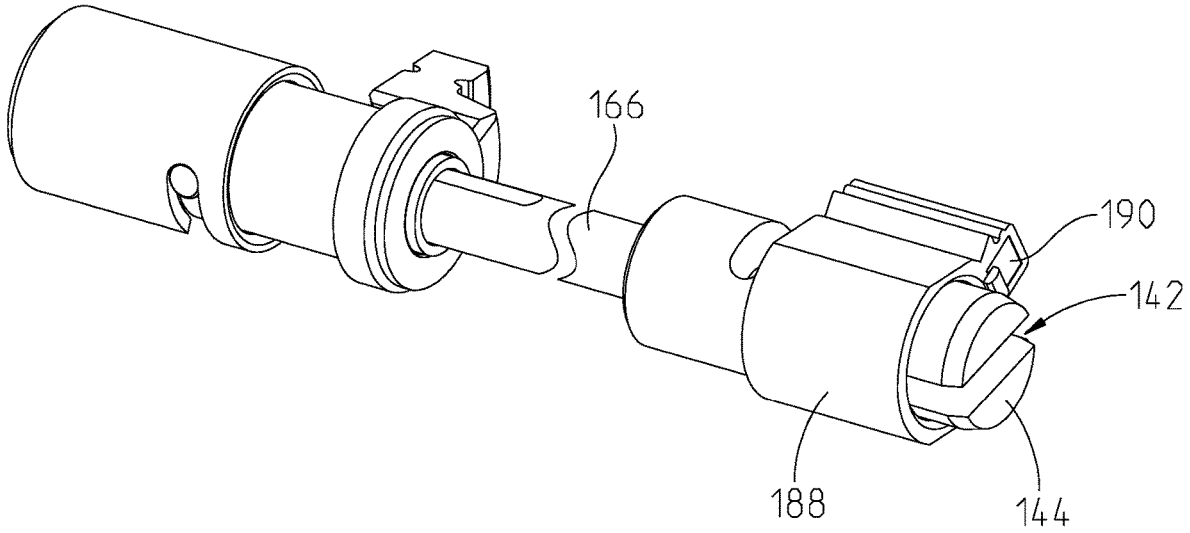
FIG. 35 is a perspective view of the locking bushing bar and associated components of the intruder function door lock of FIGS. 22-25.
Figure 36:
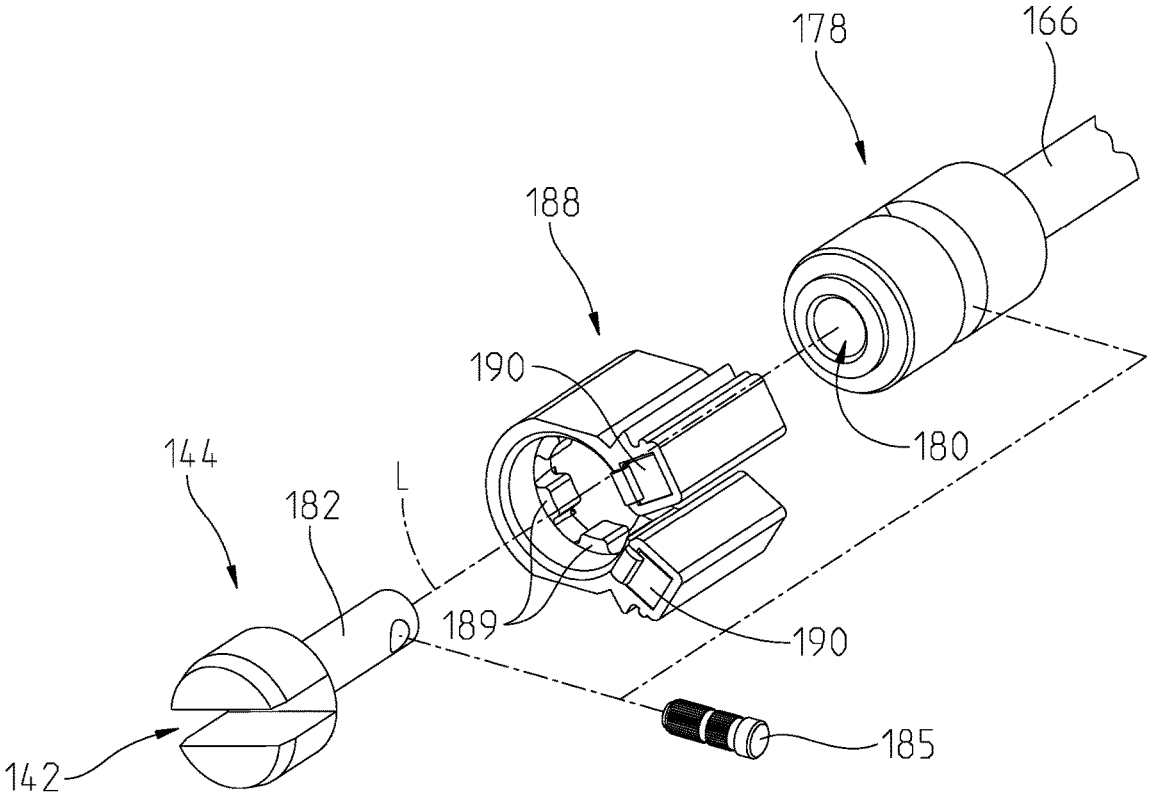
FIG. 36 is an exploded view thereof.

Referring, e.g., to FIGS. 23 and 26, egress connection end 178 of locking bushing bar 166 includes longitudinal aperture 180 into which stem 182 of key cam 144 is inserted in construction. With stem 182 positioned in longitudinal aperture 180, guide pin 185 is inserted through perimeter groove 187 and secured to stem 182 of key cam 144. More particularly, magnet holder 188 is interposed between key cam 144 and egress connection end 178 of locking bushing bar 166 as illustrated in FIGS. 35 and 36. The function of magnet holder 188 is similar to the function of magnet holder 88 described above. The operation of magnet holder 188 in intruder function door lock 130 is further described below.

With guide pin 185 inserted through perimeter groove 187 and secured to stem 182 of key cam 144, key cam 144 is secured for translation (along longitudinal axis L) with locking bushing bar 166. In this position, key cam 144 is; however, rotatable relative to locking bushing bar 166 through an arcuate travel defined by perimeter groove 187. This arcuate travel will allow for an amount of lost motion, which facilitates ingress and egress locks functioning in cooperation one with the other. Perimeter groove 187 is not shown to scale and will be sized to allow proper functioning of ingress and egress locks as further described herein.

When locking intruder function door lock at the ingress side (with the lock positioned in lock opening 140 of ingress handle 134), key cam 144 is held stationary by the egress throw member positioned in slot 142 of key cam 144, while the ingress throw member is actuated by the ingress lock to rotate cam 148. During rotation of cam 148 by the ingress throw member to effect locking of intruder function door lock 130, guide pin 185 (which is held stationary by the egress throw member) also holds locking bushing bar 166 (and, consequently, key release bushing 150) against rotation so that rotation of cam 148 effects axial displacement of key release bushing 150 and, consequently, locking lug 158, as detailed above. Axial displacement of key release bushing 150 as guide pin 154 rides along helical slot 156 of cam 148 during rotation of cam 148 also causes axial displacement of key cam 144 at the egress side of intruder function door lock 130. The egress throw member and slot 142 of key cam 144 are sized such that the egress throw member remains positioned in slot 142 to rotationally link the egress throw member and key cam 144 during the full axial travel of key release bushing 150 between the locked and unlocked positions of locking lug 158.

When locking intruder function door lock 130 at the egress side (with the lock positioned in lock opening 138 of egress handle 132), cam 148 is held stationary by the ingress throw member positioned in slot 146, while the egress throw member is actuated by the egress lock to rotate key cam 144. During rotation of key cam 144 by the egress throw member to effect locking of intruder function door lock 130, guide pin 185 is positioned to transfer rotation of key cam 144 to rotation of locking bushing bar 166. Rotation of locking bushing bar 166 results in rotation of key release bushing 150. With cam 148 held against rotation by the ingress throw member, rotation of key release bushing causes guide pin 154 to ride along helical slot 156 of cam 148 to axially displace key release bushing 150 and, consequently, locking lug 158, as described further herein. Unlocking with the ingress and egress locks is performed in a conventional fashion, with a first rotation of each throw member (ingress and egress) effecting locking of intruder function door lock 130 and a second rotation opposite to the first rotation of each throw member effecting unlocking of intruder function door lock 130.

Intruder function door lock 130 features a lock indicator having shared components with the lock indicators described with respect to entry function door lock 30 and privacy function door lock 60, with shared lock indicator components being identified with respect to intruder function door lock 130 with similar reference numerals to those used with entry function door lock 30, but with 100 added. Unless specified in this document, the lock indicator of intruder function door lock 130 functions in the same way as the lock indicator of entry function door lock 30 and vice versa. For the sake of brevity, not all shared structures and functions are described with respect to all of the lock indicators disclosed in this document.

Figure 24:
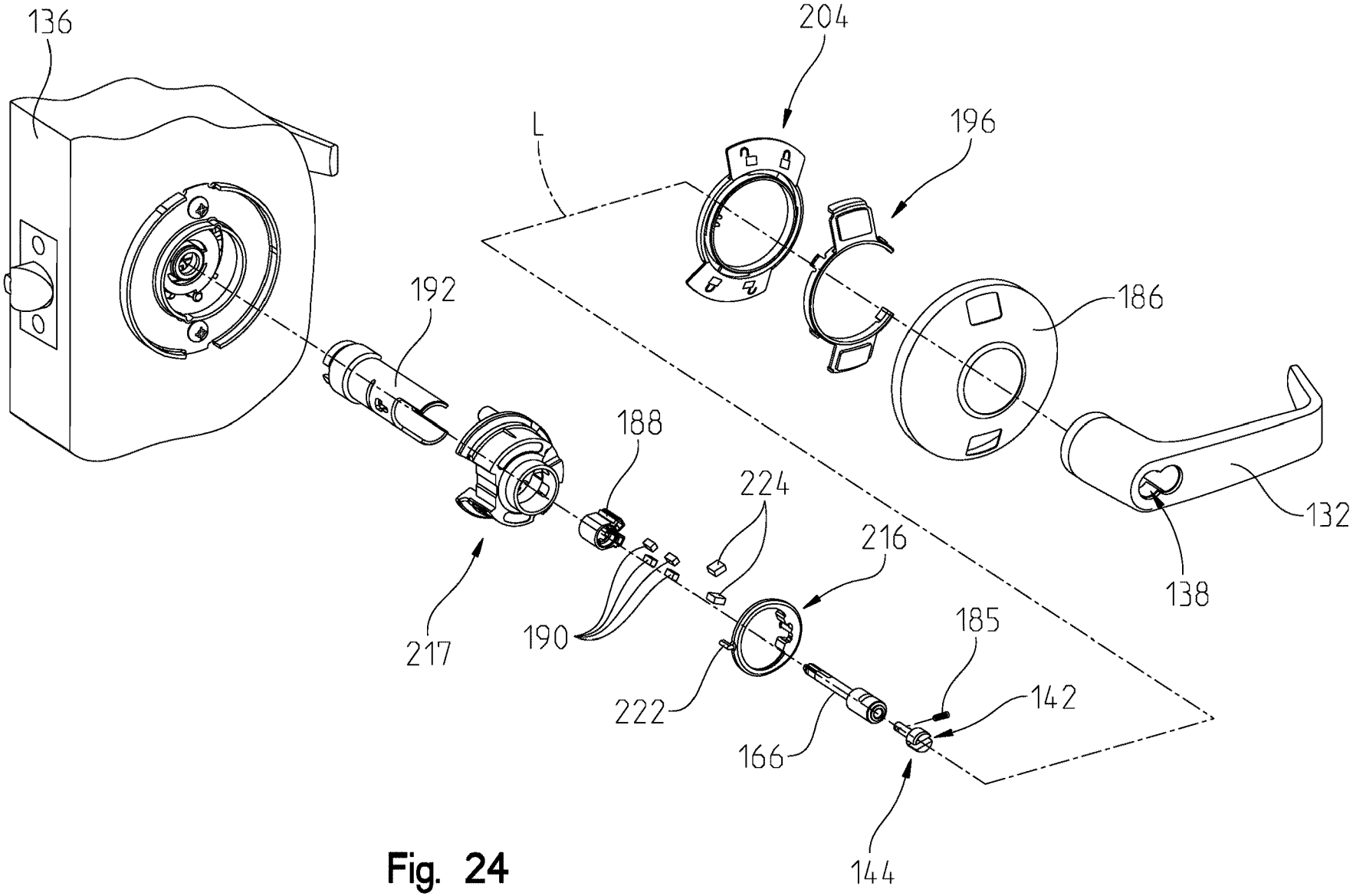
FIG. 24 is an exploded view of the egress side of the intruder function door lock of FIGS. 22 and 23.
Figure 25:
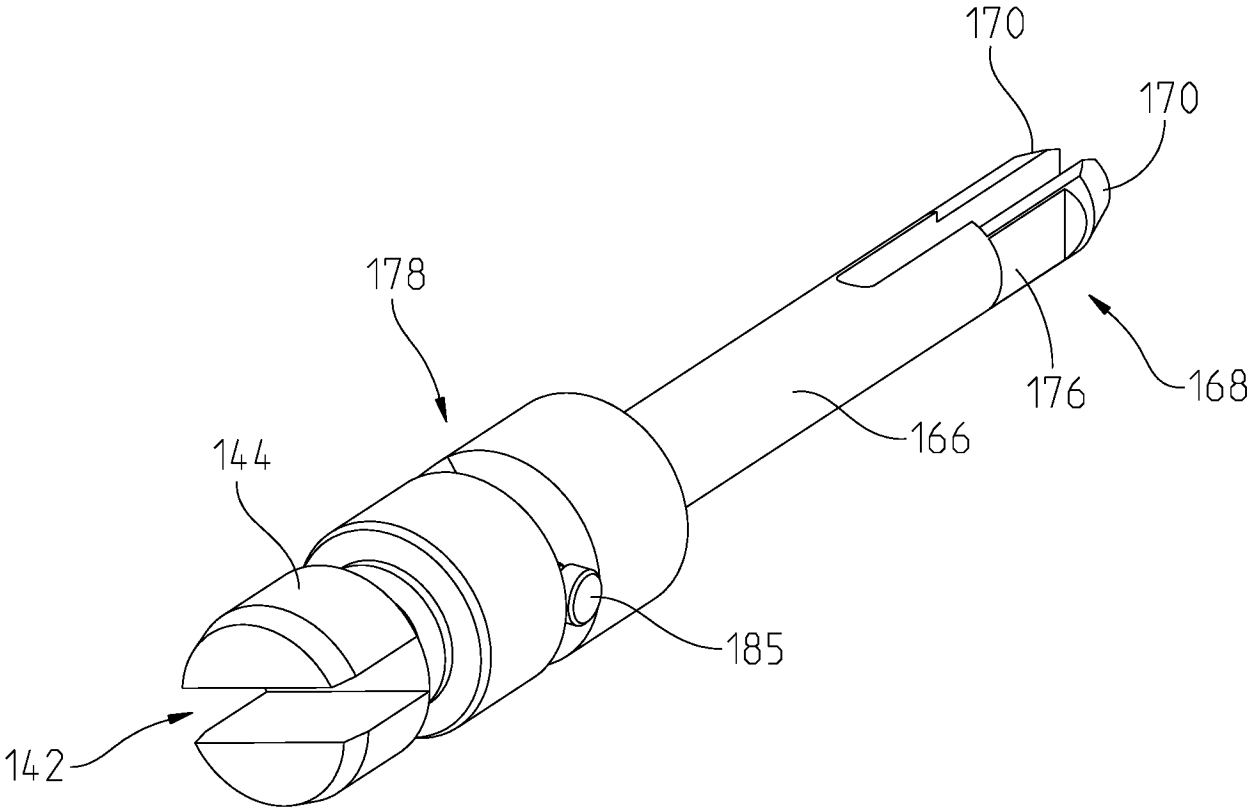
FIG. 25 is a perspective view of a locking bushing bar of the intruder function door lock of FIGS. 22-24

FIGS. 24 and 34-41 show details of the lock indicator of intruder function door lock 130. Referring to FIG. 24, the transverse aperture through door 136 through which cylindrical lock 130 is installed is covered on the egress and ingress sides by a rose 186, which is secured stationary relative to door 136. In the present disclosure, rose 186 is utilized to display an indicator of the lock or unlock status of intruder function door lock 130 on the egress side of intruder function door lock 130, i.e., from the rose 186 associated with egress handle 132. As indicated above, in the case of privacy function door lock 60, the indicator is visible on the outside of the lock, i.e., from the rose 86 associated with ingress handle 34. Although the present disclosure is exemplified by indicators on one of the inside and outside (i.e., the egress and ingress sides, respectively), if desired, both inside and outside status indicators could be utilized on the same lock.

Referring to FIGS. 24 and 34-36, magnet holder 188 is axially secured to locking bushing bar 166, i.e., magnet holder 188 moves along longitudinal axis L together with locking bushing bar 166. Because locking bushing bar 166 is axially translated by actuation of intruder function door lock between the locked and unlocked positions by both the ingress and egress locks of intruder function door lock 130, magnet holder 188 is operable to trigger the lock indicator without regard to which lock is utilized to establish the locked or unlocked status of intruder function door lock 130.

Magnet holder 188 carries magnets 190, which will be utilized to actuate the status indicators of the present disclosure. Locking bushing bar 166 is free to rotate relative to magnet holder 188 so that rotation of bushing bar 166 during a locking or unlocking triggered at the egress lock of intruder function door lock 130 will not affect or be resisted by the rotational position of magnets 190 about longitudinal axis L. Referring to FIG. 36, magnet holder 188 includes inward radial protrusions 189 that are positioned intermediate the head of key cam 144 and egress connection end 178 of locking bushing bar 166. When assembled as illustrated in FIG. 35, the head of key cam 144 is spaced from egress connection end 178 of locking bushing bar 166 to allow rotation of magnet holder 188 relative to both key cam 144 and locking bushing bar 166. Magnet holder 188 is maintained in a rotational position by sleeve 192 is similar fashion to sleeve 92 and magnet holder 88 described above.

Figure 34:
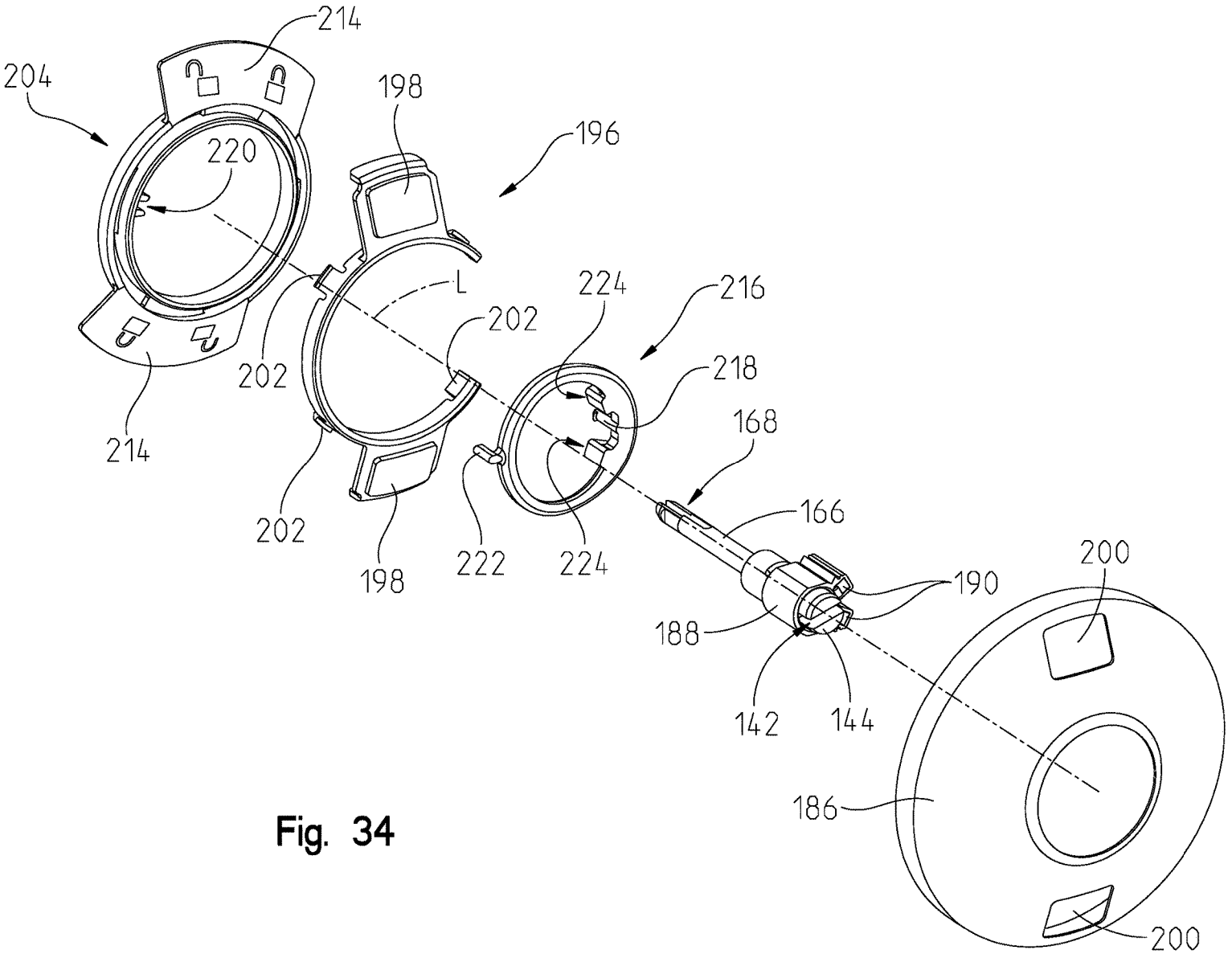
FIG. 34 is an exploded view of an indicator assembly useable with the intruder function door lock of FIGS. 22-25.
Figure 39:
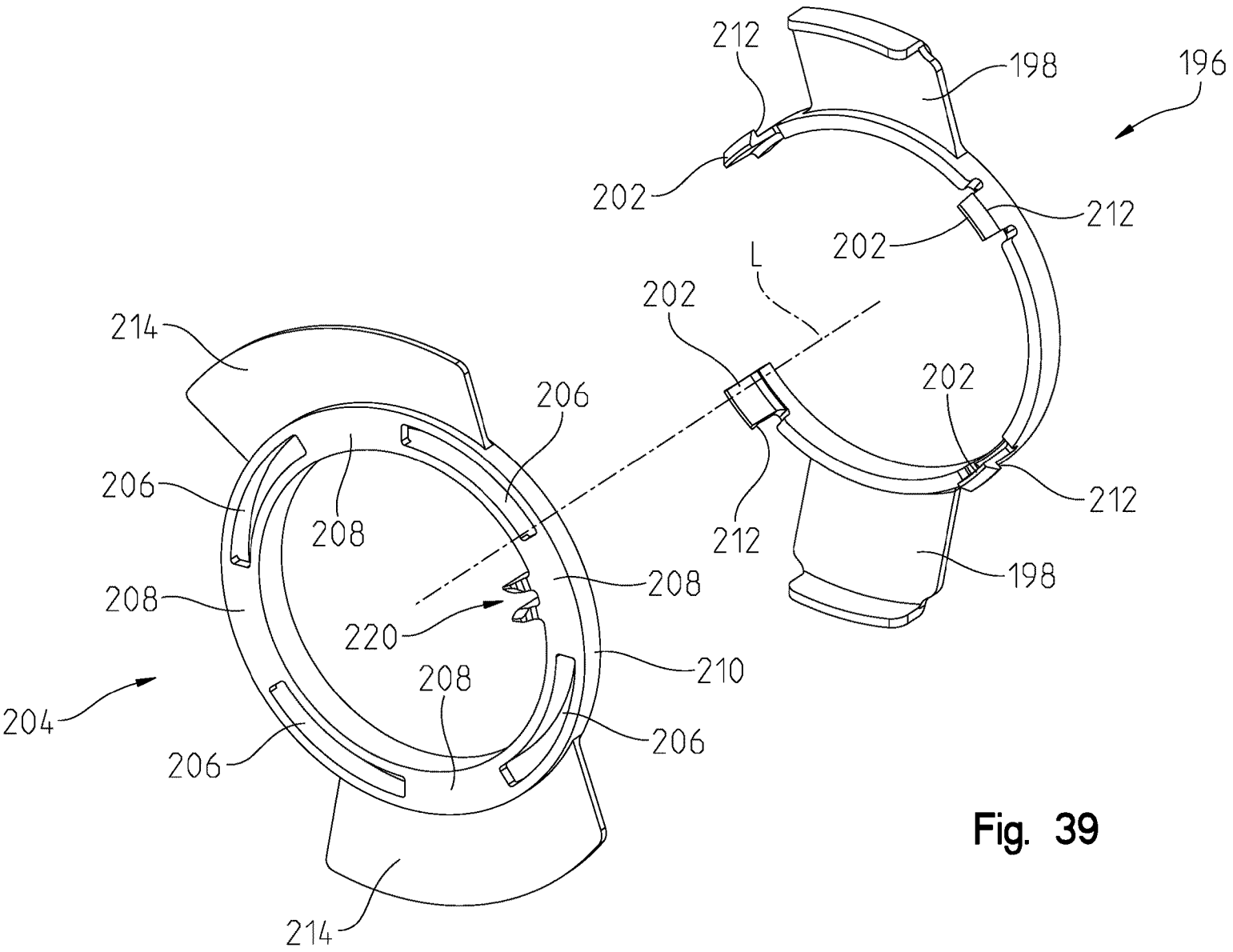
FIG. 39 is an exploded, perspective view of a lens and indicator of the present disclosure.

Referring, e.g., to FIG. 34, lens 196 is secured to rose 186, with windows 198 protruding through window apertures 200. An adhesive may be employed to effect such securement. With lens 196 secured to rose 186, retainers 202 are available to axially fix indicator 204 thereto. Referring to FIG. 39, indicator 204 includes annular grooves 206, into which retainers 202 can be inserted between stops 208. To insert retainers 202 into annular grooves 206, outer ring 210 radially inwardly displaces retainers 202 as it rides over the ramped surfaces at the distal ends of retainers 202. After these ramped surfaces clear outer ring 110, retainers 202 spring back (radially outwardly) to their positions prior to displacement by outer ring 210. At this point, indicator 204 is trapped between windows 198 and stop surfaces 212 of retainers 202 to prevent axial displacement of indicator 204 relative to lens 196. In this position, indicator 204 is rotatable relative to lens 196 within a range of motion defined by retainers 202 and stops 208.

Indicator 204 includes flags 214 corresponding to windows 198. Each flag 214 includes a locked status indicator and an unlocked status indicator, only one of which is visible through windows 198 at each at rest position of indicator 204. The locked status indicator and unlocked status indicator of each flag 214 is positioned such that both windows 198 will display the same status indicator (i.e., locked or unlocked) at each at rest position of indicator 204. The locked status indicator may be a graphical indicator and/or a color indicator. Similarly, the unlocked status indicator may be a graphical indicator and/or a color indicator. For example, the unlocked status indicator may be a green portion of each flag 214, while the locked status indicator may be a red portion of each flag 214.

Referring, e.g., to FIG. 34, rocker 116 is operable to actuate indicator 104 between indicating a locked condition and an unlocked position of lock 30, 60. Referring, e.g., to FIG. 10, rocker 16 is pivotally connected to the chassis of lock 30, 60 by pivot pin 18. With rocker 116 pivotally secured to the lock chassis, and indicator 104 secured to rose 86 via lens 96, yoke 120 can be aligned with pin 122 of rocker 116 to allow rose 86 to be secured relative to door 36 with indicator 114 operably positioned. Indicator 114 is operably positioned with pin 122 of rocker 116 trapped by yoke 120 of indicator 104 such that pivoting of rocker 116 about pivot pin 18 causes rotation of indicator 104 about lens 96.

Figure 41:
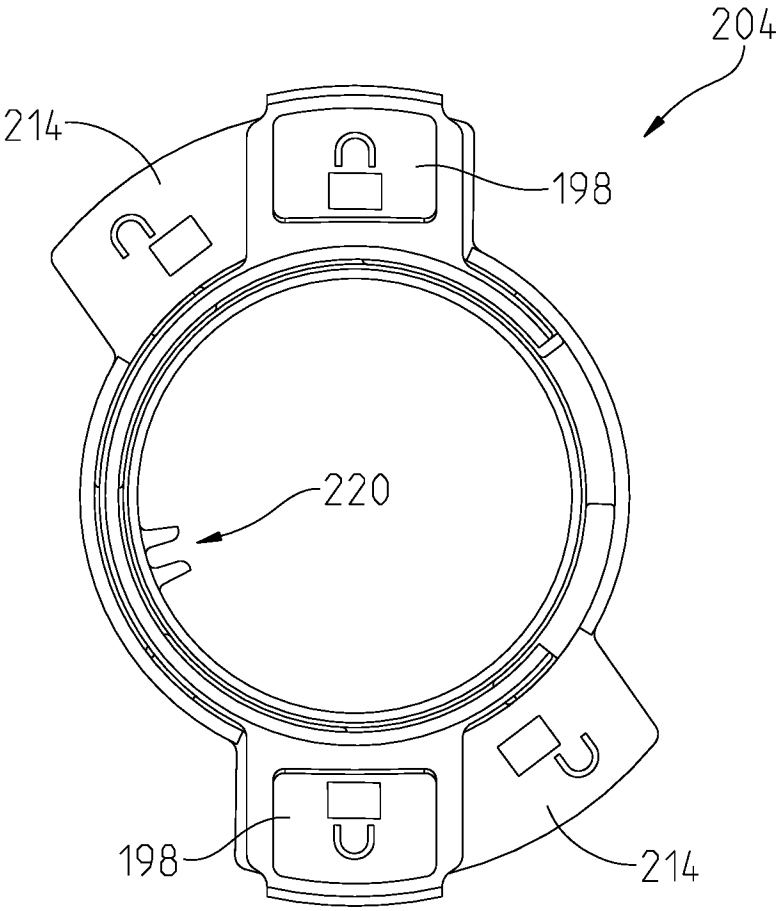
FIGS. 40 and 41 are plan views of the lens and indicator of FIG. 39 shown in position to display the unlock signal and lock signal, respectively.
Figure 40:
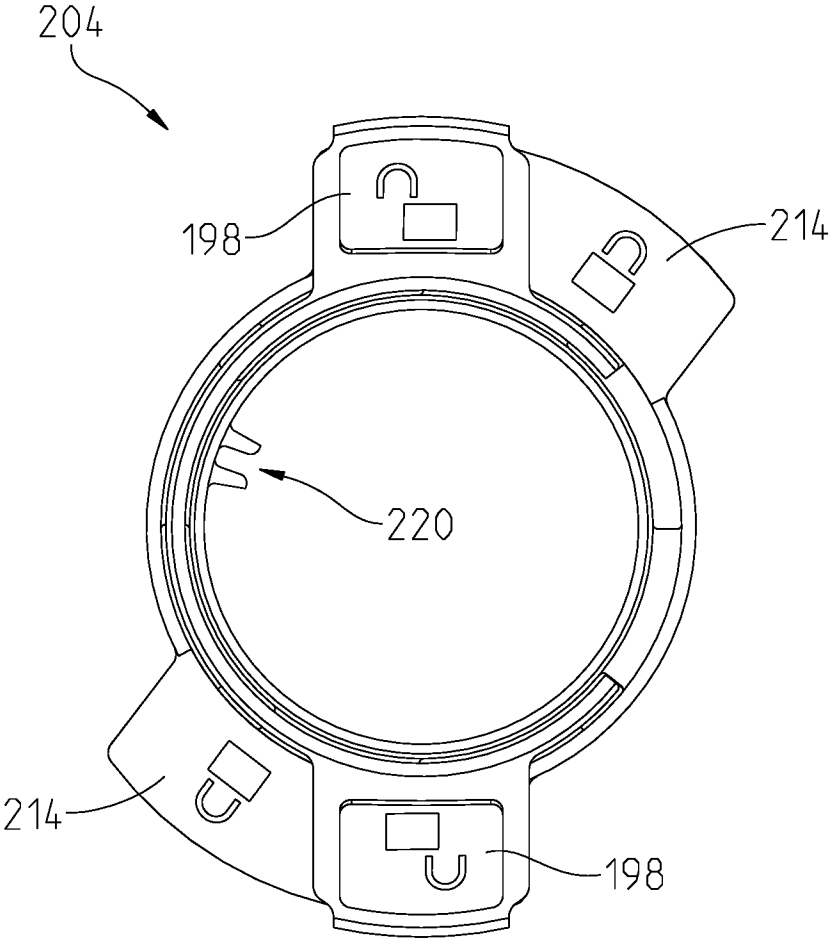

FIGS. 40 and 41 illustrate flags 214 positioned with respect to windows 198 in the unlocked and locked positions, respectively. In FIGS. 40 and 41, unlock and lock graphics are used as status indicators. As previously indicated, alternative indicators or signals such as color or text indicators may be alternatively or additionally used. In the unlocked indication position of FIG. 40, the unlock graphics are positioned beneath and viewable through windows 98. In the locked indication position of FIG. 41, the lock graphics are positioned beneath and viewable through windows 98.

Figure 37:
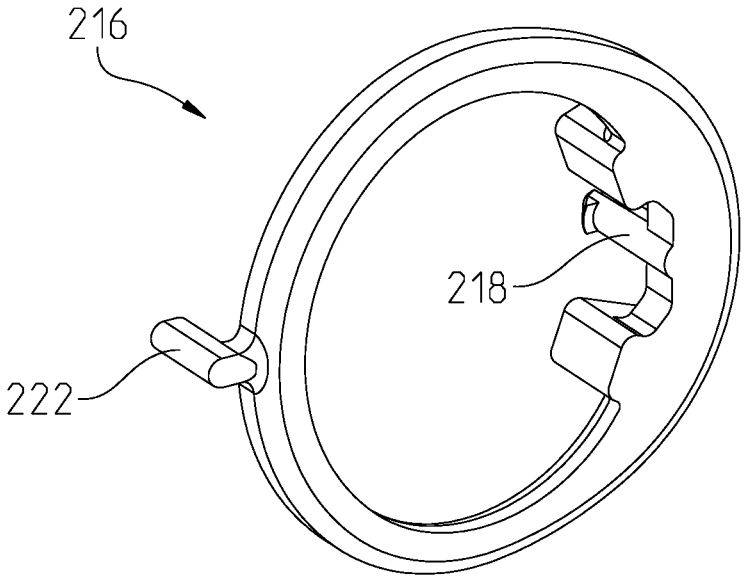
FIGS. 37 and 38 are opposing perspective views of a rocker in accordance with the present disclosure.
Figure 38:
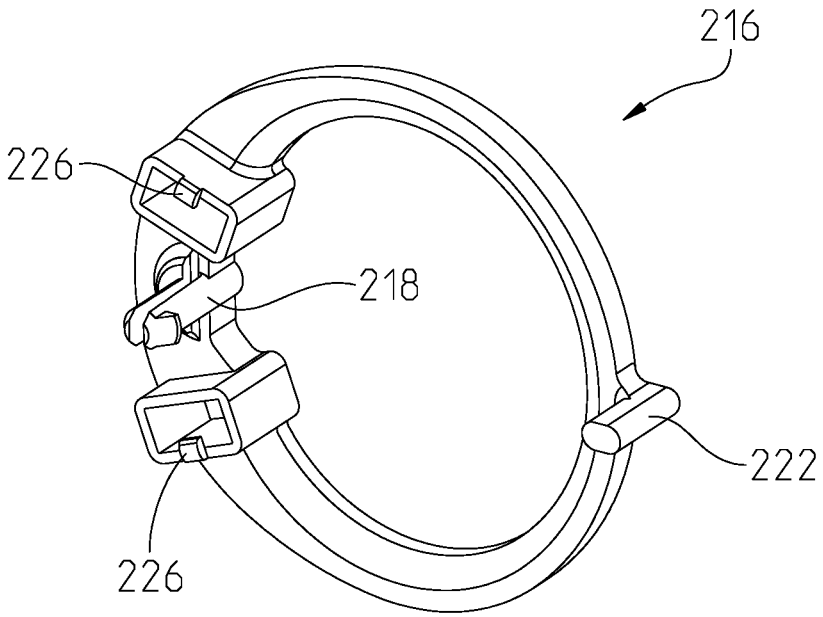

Indicator 204 is actuated between the unlocked indicator position (FIG. 40) and the locked indicator position (FIG. 41) by rocker 216 (see, e.g., FIGS. 34, 37 and 38). Referring to FIGS. 23 and 34, rocker 216 is rotatably supported by hub 217. More particularly, pivot pin 218 is snap fit into aperture 219 in hub 217. When assembled as illustrated in FIG. 23, pin 222 of rocker 216 is trapped in yoke 220 (see, e.g., FIGS. 34, 40, and 41) of indicator 204. Therefore, pivoting of rocker 216 about the longitudinal axis of pivot pin 218 causes a responsive rotation of indicator 204 about longitudinal axis L. The longitudinal axis of pivot pin 28 intersects door 136, as does longitudinal axis L. The pivot axis defined by pivot pin 28 is space from longitudinal axis L, about which rocker 216 (as well as egress handle 132 and ingress handle 134) rotate. With pivot pin 218 pivotally connected to hub 217, rocker 216 is actuatable (as further described herein) between two positions as illustrated with respect to rocker 116 in FIGS. 5 and 6. Rocker 216 will occupy a first pivotal position (FIG. 5) when indicator 204 displays the unlocked graphic through windows 198 (FIG. 40) and will occupy a second pivotal position different from the first position (FIG. 6) when indicator 204 displays the locked graphic through windows 198 (FIG. 41). The first and second pivotal positions of rocker 216 are identical to the pivotal positions of rocker 116 described above and are; therefore, not depicted to avoid unnecessary duplication of FIGS.

Rocker 216 carries magnets 224 (FIG. 24) which cooperate with magnets 190 of magnet holder 188 to effect movement of indicator 204 between the unlocked indication position and the locked indication position illustrated in FIGS. 40 and 41, respectively. Magnets 224 are aligned with magnets 190 such that the magnetic force of magnets 224, 190 will position rocker 216 in one of the positions illustrated with respect to rocker 116 in FIGS. 5 and 6, depending on whether intruder function door lock 130 maintains the locked or locked position as described herein. Magnets 190 of magnet holder 188 function in the same way as magnets 90 of magnet holder 88 detailed above. Like magnet 90 illustrated in FIG. 17, magnets 190 in magnet holder 188 present two negative magnet poles adjacent to rocker 216 in the unlock position of locking bushing bar 166 (and locking lug 158) described above. Like magnet 90 illustrated in FIG. 18, magnets 190 in magnet holder 188 present two positive magnet poles adjacent to rocker 216 in the unlock position of locking bushing bar 166 (and locking lug 158) described above. Magnets 224 carried by rocker 216 present one radially inward positive pole and one radially inward negative pole. With this arrangement of magnets, one magnet 224 carried by rocker 216 is magnetically attracted toward magnet holder 188, while the other magnet 224 carried by rocker 216 is magnetically repelled away from magnet holder 188. The attraction and repulsion are reversed depending on whether intruder function door lock 130 is locked or unlocked. The magnetic forces retaining rocker 216 (or rocker 116) in a first position may cumulatively or individually be referred to as a first magnetic force, while the magnetic forces retaining rocker 216 (or 116) in a second position different from the first position may cumulatively or individually be referred to as a second magnetic force.

As with the previously described embodiments, alternative magnet arrangements will also provide the desired functionality. For example, magnets 224 carried by rocker 216 may present the same (both positive, or both negative) poles radially inwardly and adjacent to magnet holder 188, in which case, magnet holder 188 would present one positive and one negative pole radially outwardly adjacent to rocker 216. The position of the positive and negative poles presented by magnet holder 188 radially outwardly and adjacent to rocker 216 would be reversed from the position illustrated in FIG. 17 with respect to magnet holder 88 to the position illustrated in FIG. 18 with respect to magnet holder 88. While these alternatives would function to properly display the lock status with egress handle 132 at rest, problems could arise when egress handle 132 was actuated. This is because rotation of egress handle 132 causes rotation of sleeve 192.

Egress handle 132 (and with it, sleeve 192) can be rotated either clockwise or counterclockwise to actuate the latch bolt of intruder function door lock 130 when intruder function door lock 130 maintains its unlocked state. If egress handle 132 (and sleeve 192) is rotated clockwise, the negative magnet on rocker 216 will no longer be positioned to be repelled by one of the negative magnets held by magnet holder 188 (see FIG. 17); however, this negative magnet of magnet holder 188 will be positioned to attract the positive magnet held by magnet holder 188. In this way, the positive magnet attraction establishing the position of rocker 216 will be maintained through actuation of egress handle 132 to actuate the latch bolt associated with intruder function door lock 130. Similarly, if egress handle 132 (and sleeve 192) is rotated counterclockwise, the positive magnet on rocker 216 will no longer be positioned to be attracted by one of the negative magnets held by magnet holder 188; however, this negative magnet of magnet holder 188 will be positioned to repel the negative magnet held by magnet holder 188. In this way, the magnetic repulsion establishing the position of rocker 216 will be maintained through actuation of egress handle to actuate the latch bolt associated with intruder function door lock 130.

Advantageously, the lock indicators of the present disclosure are contained between the door and a standard sized rose.

While an inside indication of the lock/unlock status of a lock is generally described alternatively with an entry function or an intruder function, and an outside indication of the lock/unlock status of a lock is generally described with a privacy function in this document, it will be understood that both inside and outside indicators can be provided with any lock. For example, an outside indication could be provided with an entry function or an intruder function, and an inside indication could be provided with a privacy function.

Additional details of lock status indicators can be found in U.S. Provisional Patent Application Ser. No. 63/033,806 filed Jun. 2, 2020, entitled LOCK STATUS INDICATOR and filed on even date herewith, as well as in U.S. Provisional Patent Application No. 63/033,034, filed Jun. 1, 2020 entitled CYLINDRICAL LOCK STATUS INDICATOR and filed on even date herewith, the entire disclosures of each of which are hereby incorporated by reference in their entireties.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An access device operable to selectively block and permit access through a barrier, comprising:

an egress actuator operable to receive an egress operator input motion to actuate the egress actuator to allow egress through the barrier from an egress side of the barrier;

an ingress actuator operable to receive an ingress operator input motion to actuate the ingress actuator to allow ingress through the barrier from an ingress side of the barrier;

a lock actuatable between a locked position and an unlocked position, the locked position of the lock positioning the lock in a locked condition blocking the ingress operator input motion from actuating the ingress actuator to allow ingress through the barrier;

an indicator having a lock signal signaling the locked position of the lock and an unlock signal signaling the unlocked position of the lock, the indicator selectively displaying only one of the lock signal and the unlock signal, the indicator having a lock signal display position in which the lock signal is displayed and an unlock signal display position in which the unlock signal is displayed;

a first magnet secured for movement with the lock between the locked position and the unlocked position; and a second magnet pivotable by the first magnet between a second magnet lock position and a second magnet unlock position, the second magnet pivotable between the second magnet lock position and the second magnet unlock position about a pivot axis intersecting the barrier, in the second magnet lock position a first magnetic force between the first magnet and the second magnet retaining the indicator in the lock signal display position, in the second magnet unlock position a second magnetic force between the first magnet and the second magnet retaining the indicator in the unlock signal display position;

wherein the indicator is rotatable between the lock signal display position and the unlock signal display position about an axis of rotation spaced from the pivot axis.

2. The access device of claim 1, wherein the first magnet is secured for axial movement with the lock between the locked position and the unlocked position.

3. The access device of claim 1, wherein the lock further comprises:

a rose, the indicator positioned intermediate the barrier and the rose, the rose including a window through which the lock signal and the unlock signal are selectively viewable.

4. The access device of claim 1, further comprising:

a rocker carrying the second magnet and pivotable about the pivot axis.

5. The access device of claim 4, wherein the rocker comprises a pin retained in a yoke, the yoke secured for rotation with the indicator, the yoke rotatable about the axis of rotation by the pivoting of the rocker.

6. The access device of claim 1, wherein the indicator is viewable from the egress side of the barrier, the egress actuator extending from the egress side of the barrier, the egress actuator rotatable by the egress operator input motion, the first magnet comprising a pair of first magnets secured for rotation with the egress actuator, in a default position of the egress actuator, the pair of first magnets both supplying one of the first magnetic force and the second magnetic force, rotation of the egress actuator by the egress operator input motion rotating one of the pair of first magnets out of position to supply the one of the first magnetic force and the second magnetic force while the other of the pair of first magnets remains positioned to supply the one of the first magnetic force and the second magnetic force.

7. An access device operable to selectively block and permit access through a barrier, comprising:

an egress actuator operable to receive an egress operator input motion to actuate the egress actuator to allow egress through the barrier from an egress side of the barrier;

an ingress actuator operable to receive an ingress operator input motion to actuate the ingress actuator to allow ingress through the barrier from an ingress side of the barrier;

a lock actuatable between a locked position and an unlocked position, the locked position of the lock positioning the lock in a locked condition blocking the ingress operator input motion from actuating the ingress actuator to allow ingress through the barrier;

a rose having a window;

an indicator having a lock signal signaling the locked position of the lock and an unlock signal signaling the unlocked position of the lock, the lock signal and the unlock signal positioned intermediate the barrier and the rose, the indicator selectively displaying only one of the lock signal and the unlock signal through the rose window, the indicator having a lock signal display position in which the lock signal is displayed through the rose window and an unlock signal display position in which the unlock signal is displayed through the rose window;

a first magnet moved by movement of the lock between the locked position and the unlocked position;

a second magnet moveable by the first magnet between a second magnet lock position and a second magnet unlock position, in the second magnet lock position a first magnetic force between the first magnet and the second magnet retains the indicator in the lock signal display position, in the second magnet unlock position a second magnetic force between the first magnet and the second magnet retains the indicator in the unlock signal display position; and a rocker carrying the second magnet and pivotable about a pivot axis, the second magnet pivotable by the first magnet between the second magnet lock position and the second magnet unlock position, the rocker positioned intermediate the barrier and the rose;

wherein the indicator is rotatable between the lock signal display position and the unlock signal display position about an axis of rotation spaced from the pivot axis.

8. The access device of claim 7, wherein the rocker comprises a pin and the indicator comprises a yoke, the pin retained in the yoke, the yoke rotatable about the axis of rotation by the pivoting of the rocker.

9. The access device of claim 7, wherein the egress actuator extends through the rose.

10. The access device of claim 7, wherein the ingress actuator extends through the rose.

11. An access device operable to selectively block and permit access through a barrier, comprising:

an actuator operable to receive an operator input motion to rotate the actuator to allow access through the barrier, the actuator extending from a first side of the barrier;

a lock actuatable between a locked position and an unlocked position, the locked position of the lock positioning the lock in a locked condition blocking the operator input motion from rotating the actuator to allow access through the barrier;

an indicator having a lock signal signaling the locked position of the lock and an unlock signal signaling the unlocked position of the lock, the indicator selectively displaying only one of the lock signal and the unlock signal the indicator having a lock signal display position in which the lock signal is displayed and an unlock signal display position in which the unlock signal is displayed;

a first pair of magnets moved by movement of the lock between the locked position and the unlocked position;

a second pair of magnets pivotable by the first pair of magnets between a second magnet lock position and a second magnet unlock position, in the second magnet lock position the first pair of magnets and the second pair of magnets cooperating to position the indicator in the lock signal display position, in the second magnet unlock position the first pair of magnets and the second pair of magnets cooperating to position the indicator in the unlock signal display position; and a rocker carrying the second pair of magnets and pivotable about a pivot axis between the second magnet lock position and the second magnet unlock position, the actuator rotatable about a rotation axis spaced from the pivot axis, in one of the second magnet lock position and the second magnet unlock position, one of the first pair of magnets is repulsed by one of the second pair of magnets while the other of the first pair of magnets is attracted by the other of the second pair of magnets, rotation of the actuator by the operator input motion rotating the one of the first pair of magnets to a position attracted by the other of the second pair of magnets, whereby the second pair of magnets maintains the one of the second magnet lock position and the second magnet unlock position during the operator input motion to rotate the actuator to allow access through the barrier.

12. The access device of claim 11, wherein the actuator comprises an egress actuator and the one of the second magnet lock position and the second magnet unlock position comprises the second magnet lock position.

13. The access device of claim 11, wherein the one of the second magnet lock position and the second magnet unlock position comprises the second magnet unlock position.

14. The access device of claim 11, further comprising a rose, the indicator positioned intermediate the barrier and the rose, the rose including a window through which the lock signal and the unlock signal are selectively viewable.

15. The access device of claim 11, wherein the indicator is rotatable between the lock signal display position and the unlock signal display position about the axis of rotation spaced from the pivot axis.

16. The access device of claim 11, wherein the rocker comprises a pin and the indicator comprises a yoke, the pin retained in the yoke, the yoke rotatable about the rotation axis by the pivoting of the rocker.

* * * * *